US005642952A

United States Patent [19]

Tomatsu et al.

[11] Patent Number: 5,642,952

[45] Date of Patent: Jul. 1, 1997

[54] SHEET-SUPPLY UNIT CAPABLE OF CONTROLLING SHEET-FEED OPERATIONS AND SHEET ALIGNMENT OPERATIONS USING A SINGLE SOLENOID

[75] Inventors: Yoshiya Tomatsu, Kasugai; Yoshiteru Hattori, Visai, both of Japan

[73] Assignee: Brother Kogyo Kabushiki Kaisha, Nagoya, Japan

[21] Appl. No.: 675,691

[22] Filed: Jul. 3, 1996

[30] Foreign Application Priority Data

Jul. 6, 1995 [JP] Japan ..... 7-195991
Feb. 15, 1996 [JP] Japan ..... 8-028228

[51] Int. Cl.[6] ..... B41J 13/10

[52] U.S. Cl. ..... 400/624; 400/630; 271/226

[58] Field of Search ..... 400/624, 625, 400/579, 630, 631, 629; 271/109, 226, 229

[56] References Cited

U.S. PATENT DOCUMENTS

| | | | |
|---|---|---|---|
| 4,564,187 | 1/1986 | Costa et al. | 400/624 X |
| 4,714,243 | 12/1987 | Staniszewski | 271/171 |
| 5,296,874 | 3/1994 | Nagata et al. | 400/629 X |
| 5,419,543 | 5/1995 | Nakamura et al. | 400/624 X |

*Primary Examiner*—Christopher A. Bennett
*Attorney, Agent, or Firm*—Oliff & Berridge

[57] ABSTRACT

A sheet-supply unit including a drive source for supplying rotational drive power; a supply roller supplying one sheet at a time to a sheet transport pathway when rotated; a partial gear provided so as to rotate integrally with the supply roller and be capable of receiving transmission of rotational drive power from the drive source; a lever pivotable between a transmission mode wherein rotational drive power from the drive source is transmitted to the partial gear and a non-transmission mode wherein rotational drive power from the drive source is prevented from being transmitted to the partial gear; a pair of resist rollers disposed in the sheet transport pathway for stopping and aligning a sheet supplied by the supply roller and for transporting the aligned sheet, and capable of receiving rotation drive power from the drive source; an actuator capable of switching between a first mode and a second mode; and a switching mechanism for, based on the mode of the actuator, pivoting the lever into the transmission mode so that rotational drive power from the drive source is transmitted to the partial gear and so that the supply roller rotates to supply a sheet towards the pair of resist rollers and for temporarily preventing, directly before the supplied sheet reaches the pair of resist rollers, transmission of rotational drive power from the power source to the pair of resist rollers so that the supplied sheet abuts against and is aligned by the pair of resist rollers.

15 Claims, 19 Drawing Sheets

SHEET-SUPPLY UNIT CAPABLE OF CONTROLLING SHEET-FEED OPERATIONS AND SHEET ALIGNMENT OPERATIONS USING A SINGLE SOLENOID

BACKGROUND OF THE INVENTION

1. Field of the Invention

The present invention relates to a sheet-supply unit used in an image forming device such as a copy machine, a facsimile machine, or a laser printer and more particularly to a sheet-supply unit configured to supply one sheet at a time from sheets stacked in a sheet-supply portion and to use a pair of resist rollers to align the front edge of the sheet supplied toward an image forming portion.

2. Description of the Related Art

The basic configuration of conventional image forming devices, such as those used in printers and copy machines, includes a sheet-supply mechanism for supplying sheets one at a time using rotation of a sheet-supply roller; a resist roller mechanism for using a pair of resist rollers to align the front edge of sheets supplied by the sheet-supply mechanism; and a print mechanism, such as a laser-type print mechanism, for forming an image on a supplied sheet after the sheet passes through the resist roller mechanism. An electromagnetic actuator solely for sheet-supply operations is provided in the sheet-supply mechanism. Also, an electro-magnetic actuator solely for temporarily stopping drive of the resist rollers is provided to the resist roller mechanism.

An example of such a conventional image forming device will be explained with reference to a sheet-supply mechanism 110 provided to a typical laser printer 100 shown in FIGS. 1 and 2. A sheet-supply roller 111 is provided for supplying, one sheet at a time, recording sheets P contained in a sheet-supply cassette 104. A partial gear 112 and a cam plate 113 are attached integrally to an end of the sheet-supply roller 111. The cam plate 113 includes a spring receiving cam 114 and a stop cam 115 formed integrally with each other. A stop lever 117 is swingably fixed to a cover of the laser printer 100. The stop lever 117 has a engagement portion 117*a* for engaging with an engagement protrusion 115*a* of the stop cam 115. A pulling spring 119 constantly urges the stop lever 117 into a stop condition wherein the engagement portion 117*a* is where it is engagable with the engagement protrusion 115.

An edge of a coil spring 116 urgingly presses against the spring receiving cam 114 so that the partial gear 112 is resiliently urged to rotate and face its geared side into engagement with a drive gear 109, which is driven by a roller drive mechanism (not shown in the drawings). Further, an input lever 120 is swingably fixed to a side panel 103 and is capable of moving the stop lever 117 from a stop position indicated by a solid line to a stop-release position indicated by a two-dot chain line. A sheet-supply solenoid 122 for swinging the input lever 120 into a sheet-supply operation position indicated by the two-dot chain line at timing of sheet supply is fixed to the side panel 103.

Next, an explanation will be provided for a resist roller mechanism 130 provided downstream from the sheet-supply mechanism 110 in a sheet-feed direction. A first resist roller 130 is rotatably supported to the side panel 103 on a shaft. A second resist roller 131 for pressing against the first resist roller 130 is rotatably provided to the side panel 103. The first resist roller 130 receives and is driven by drive force from a transmission mechanism 133. The transmission mechanism 133 includes a plurality of planetary gears (not shown) configured so that when the rotation of a rotation gear 135 is prevented, the drive force received from the roller drive mechanism is transmitted to an output gear 134 so that the first resist roller 130 is driven, but when the rotation gear 135 is in a rotatable condition, the drive force is not transmitted to the output gear 134.

Further, a swing switch lever 136 having an engagement slat 136*a* engagable with the rotation gear 135 is swingably supported on a shaft to the side panel 103. A pulling spring 137 resiliently urges the engaging slat 136*a* into engagement with the rotation gear 135. Also, a transmission switching solenoid 138 is provided for switching the swing switch lever 136 from a transmission position shown in FIG. 1 to a non-transmission position shown in FIG. 2.

A sheet detection mechanism 140 is provided between the sheet-supply mechanism 110 and the resist roller mechanism 130. The sheet detection mechanism 140 includes a sheet detection swing lever 141 rotated to a predetermined angle by a supplied recording sheet P and a swing lever 142 swinging in association with the sheet detection swing lever 141.

As shown in FIG. 1, when a sheet is being supplied, the sheet-supply solenoid 122 is driven so that the input lever 120 swings to the sheet-supply operation position indicated by the two-dot chain line. At the same time, the stop lever 117 swings to the stop-release position indicated by the two-dot chain line. When engagement between the stop protrusion 115*a* of the stop cam 115 and the engagement portion 117*a* of the stop lever 117 is released, because the spring receiving cam 114 is urged by the spring force of the coil spring 116, the partial gear 112 is rotated counter-clockwise so its engagement side engages with the drive gear 109. At the same time, a recording sheet P is supplied by the rotating sheet-supply roller 111.

On the other hand, as shown in FIG. 2, after a predetermined time elapses directly after the start of sheet supply, the front edge of the recording sheet P reaches the pair of resist rollers 131, 132. At this point, the transmission switching solenoid 138 is driven for a short duration of time to switch the swing switch lever 136 from the transmission position to the non-transmission position. Because the drive force from the rotation gear 135, which is driven in a predetermined direction is not transmitted to the output gear 134, the pair of resist rollers 131, 132 stop rotating for the short duration of time. During this stopping period, the recording sheet P is aligned into a desired orientation. Afterward, the swing switch lever 136 is switched to the transmission position so that rotation of the pair of resistor rollers 131, 132 starts again and sheet supply operations of the recording sheet P continue.

The image forming device described above has two solenoids: one provided to sheet-supply mechanism and one provided to the resist roller mechanism. This increases the cost and size of the image forming device. Also, because two solenoids must be adjusted while being installed, assembly is time consuming.

SUMMARY OF THE INVENTION

It is an objective of the present invention to provide an image forming device capable of performing sheet supply operations of the sheet-supply mechanism and sheet alignment operations of the resist roller mechanism using only the electromagnetic actuator of the sheet-supply mechanism.

In order to achieve the above-described objectives, a sheet-supply unit according to the present invention includes a drive source for supplying rotational drive power; a supply roller supplying one sheet at a time to a sheet transport pathway when rotated; a partial gear provided so as to rotate integrally with the supply roller and be capable of receiving transmission of rotational drive power from the drive source; a lever pivotable between a transmission mode wherein rotational drive power from the drive source is transmitted to the partial gear and a non-transmission mode wherein rotational drive power from the drive source is prevented from being transmitted to the partial gear; a pair of resist rollers disposed in the sheet transport pathway for stopping and aligning a sheet supplied by the supply roller and for transporting the aligned sheet, and capable of receiving rotation drive power from the drive source; an actuator capable of switching between a first mode and a second mode; and a switching mechanism for, based on the mode of the actuator, pivoting the lever into the transmission mode so that rotational drive power from the drive source is transmitted to the partial gear and so that the supply roller rotates to supply a sheet towards the pair of resist rollers and for temporarily preventing, directly before the supplied sheet reaches the pair of resist rollers, transmission of rotational drive power from the power source to the pair of resist rollers so that the supplied sheet abuts against and is aligned by the pair of resist rollers.

According to another aspect of the invention, the switching mechanism includes an input lever pivoting in association with switching of the actuator between the first mode and the second mode, the input lever pivoting the lever into the transmission mode when the actuator is switched from the first mode to the second mode a first time; a switch lever allowing transmission of rotational drive power from the power source to the pair of resist rollers when in an allow posture and preventing transmission when in a disallow posture; and a connection mechanism connecting operation of the input lever and the switch lever so that, when the input lever is pivoted by a second switching of the actuator from the first mode to the second mode, the switch lever pivots into its disallow posture.

According to another aspect of the invention, the switching mechanism includes a resist clutch for interrupting transmission of rotational drive power to the pair of resist rollers when free to rotate; the lever, the lever being engagable with the resist clutch and being connected directly to the actuator so that, when the actuator is in the first mode, the lever is in the non-transmission mode and is engaged with the resist clutch, thereby preventing free rotation of the resist clutch, and so that, when the actuator is in the second mode, the lever is in the transmission mode and is disengaged with the resist clutch, thereby allowing free rotation of the resist clutch; a second lever urged to engage with the resist clutch to prevent free rotation of the resist clutch; and a cam for disengaging the second lever from the resist clutch at a predetermined rotation phase of the partial gear.

BRIEF DESCRIPTION OF THE DRAWINGS

The above and other objects, features and advantages of the invention will become more apparent from reading the following description of the preferred embodiment taken in connection with the accompanying drawings in which:

FIG. 15 (*b*) is a schematic side view showing positional relationship between a second lever and other components of the gear power transmission mechanism during a sheet-supply waiting period;

FIG. 16 (*b*) is a schematic side view showing the second lever and other components of the gear power transmission mechanism during a sheet-supply operations;

FIG. 17 (*b*) is a schematic side view showing the second lever and other components of the gear power transmission mechanism directly before start of alignment operations;

FIG. 19 (*b*) is a schematic side view showing the second lever and other components of the gear power transmission mechanism directly after alignment operations.

DETAILED DESCRIPTION OF THE PREFERRED EMBODIMENTS

Figure 1:
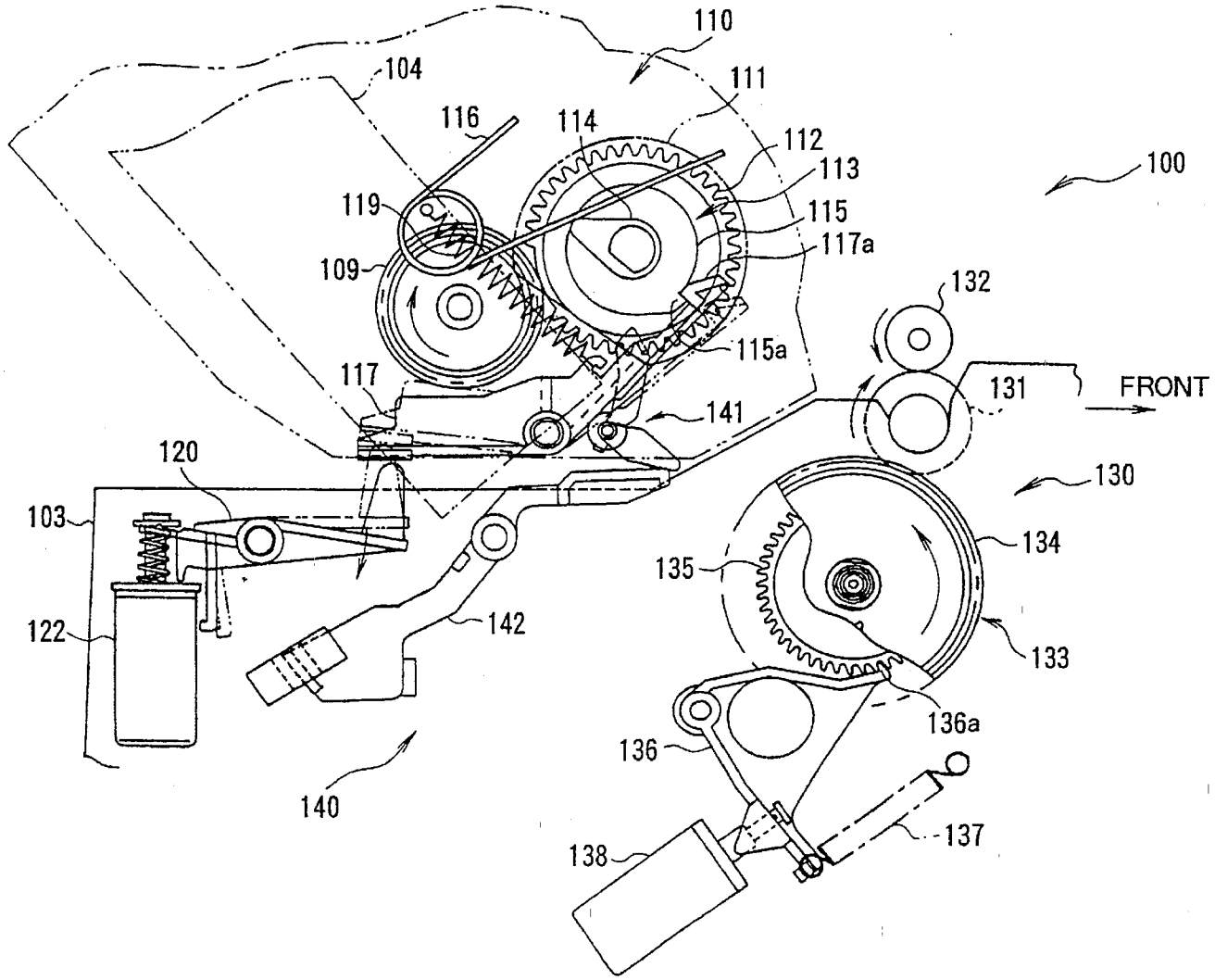
FIG. 1 is an enlarged schematic view showing a conventional sheet-supply unit just before and after start of sheet-supply operations.

A sheet-supply unit according to preferred embodiments of the present invention will be described while referring to the accompanying drawings wherein like parts and components are designated by the same reference numerals to avoid duplicating description.

The following embodiments describe the present invention applied to laser printers provided with a sheet-supply mechanism, a resist roller mechanism, and other components. With the exception of the sheet-supply mechanism and the resist roller mechanism, components of the laser printers are the same as those of a typical laser printer so will only be explained briefly here. Terms such as front, rear, left, right, up, and down will be used in the following explanation to refer to orientation of components of the sheet-supply units when the laser printers are in an orientation in which they are intended to be used.

Figure 3:
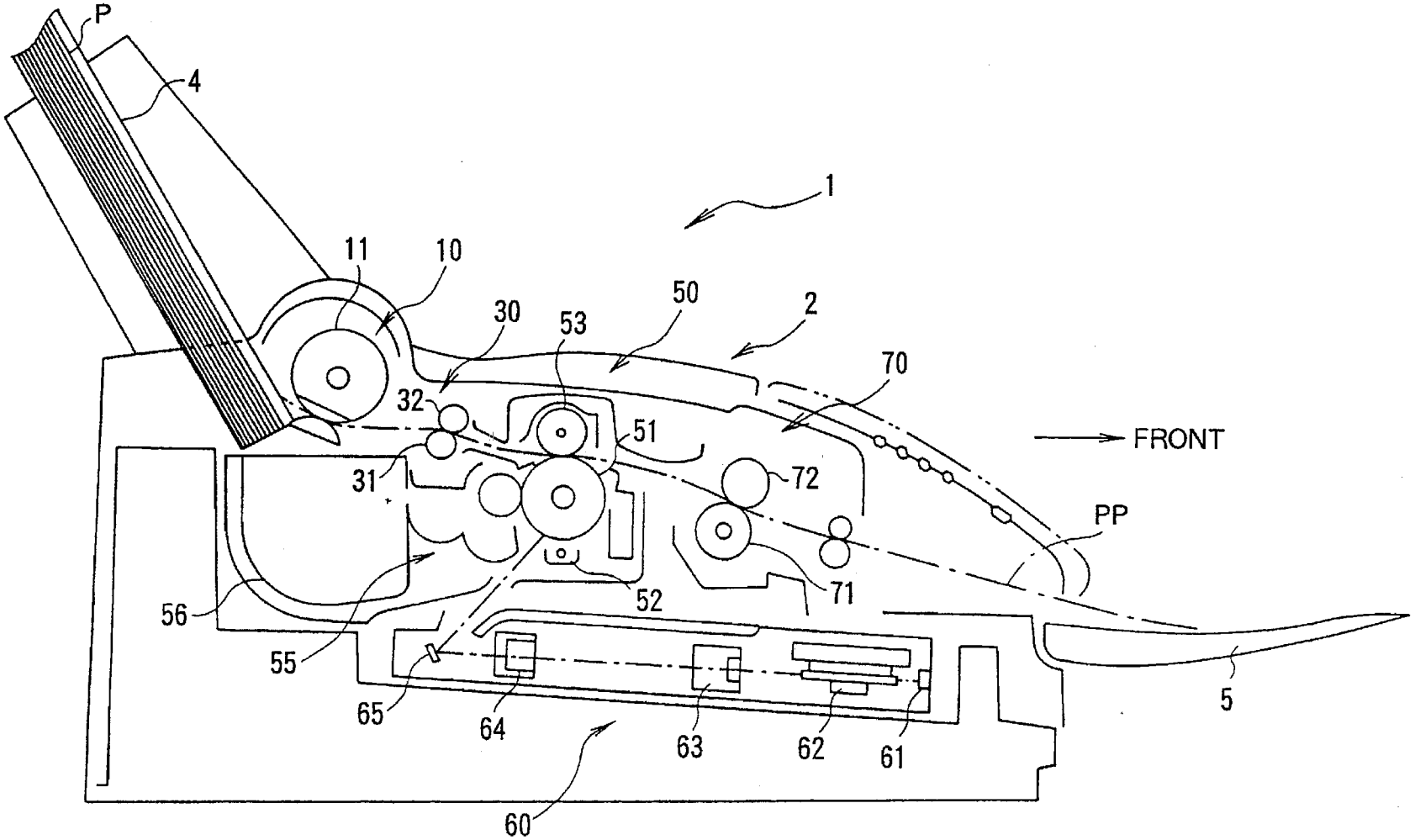
FIG. 3 is a cross-sectional view showing a laser printer to which a sheet-supply unit according to a first embodiment of the present invention is applied.

A first embodiment of the present invention describes the present invention applied to a laser printer 1. As shown in FIG. 3, a sheet-supply cassette 4 is detachably provided to the rear edge of the laser printer 1. The sheet-supply cassette 4 is filled with a plurality of recording sheets P. A sheet-supply mechanism 10 includes a sheet-supply roller 11. Drive of the sheet-supply roller 11 supplies the recording sheets P one sheet at a time. A resist roller mechanism 30 is provided downstream from the sheet-supply mechanism 10 in a sheet-feed direction. The resist roller mechanism 30 includes resist rollers 31 and 32, which align the front edge of recording sheets P supplied by drive of the sheet-supply roller 11.

Further downstream from the resist roller mechanism 30 in the sheet-feed direction are serially provided a photosensitive unit 50 including a photosensitive drum 51; a scanner unit 60 for forming a latent static-electric image on the surface of the photosensitive drum 51; a developing unit 55 for developing the latent static-electric image by impinging toner housed in a toner cartridge 56 onto the surface of the photosensitive drum 51; and a fixing unit 70 for fixing toner transposed onto a recording sheet P.

The photosensitive unit 50 includes the photosensitive drum 51, a charger 51, and a transpose roller 53. The scanner unit 60 includes a laser emission portion 61, a polygon mirror 62 driven to rotate, a pair of lenses 63, 64, and a refection mirror 65. The fixing unit 70 includes a thermal roller 71 and a pressing roller 72.

When printing is started, first the charger 51 forms a charge on the surface of the photosensitive drum 51. The laser light emitted from the laser emission portion 61 passes through the pair of lenses 63, 64, reflects off the refection mirror 65, and irradiates the surface of the photosensitive drum 51, thereby forming a latent static-electric image on the surface of the photosensitive drum 51. Next, toner supplied from the toner cartridge 56 develops the latent static-electric image. Afterward, the toner image is transposed by the transpose roller 53 onto a recording sheet P supplied by the sheet-supply mechanism 10 and the resist roller mechanism 30. Then the toner image is fixed by the thermal roller 71. Finally, the recording sheet P with the fixed toner image passes through a sheet-supply pathway to be discharged onto a discharge tray 5.

Figure 4:
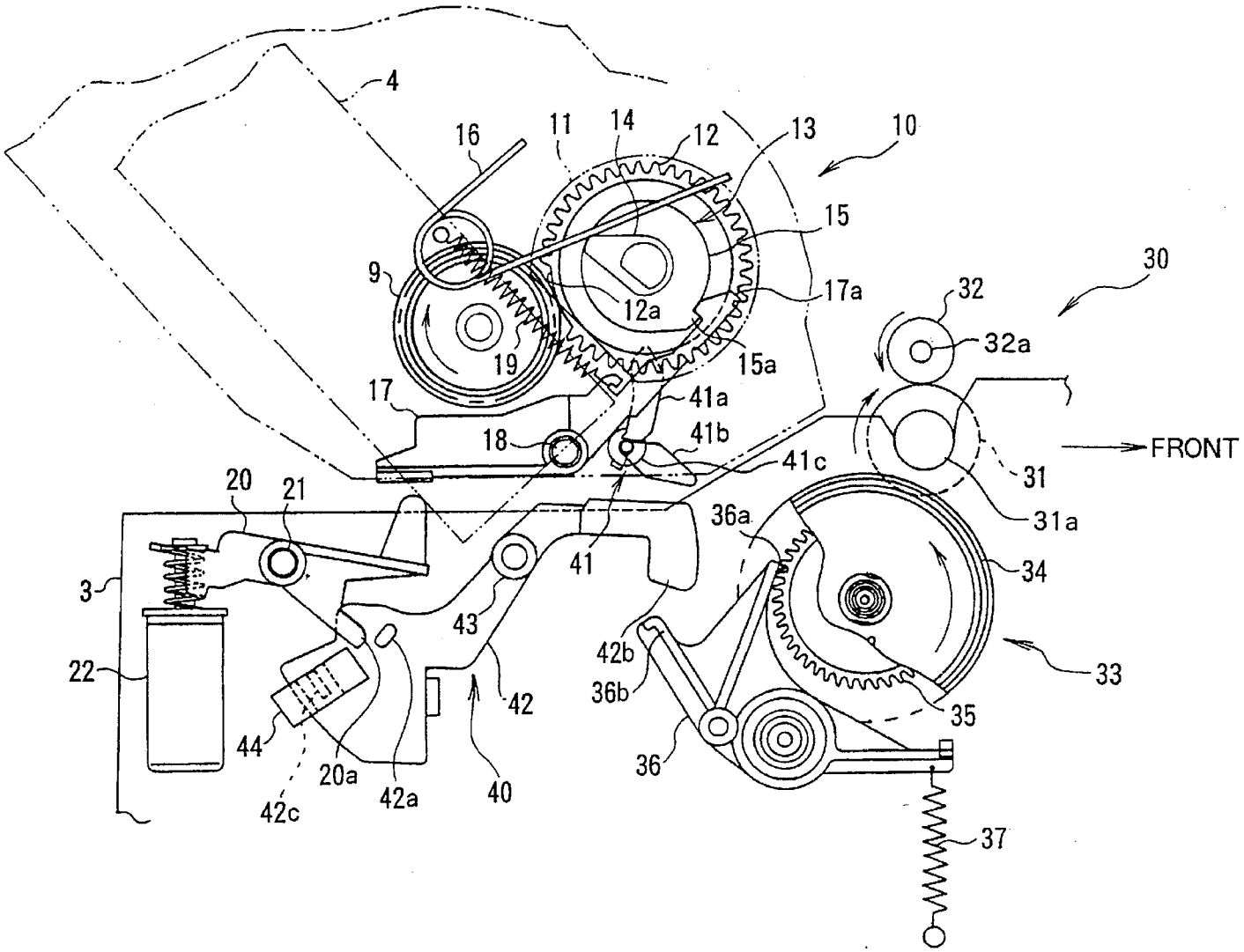
FIG. 4 is an enlarged schematic view showing the sheet-supply unit according to the first embodiment in a waiting condition.

Next, an explanation of the sheet-supply mechanism 10 for supplying recording sheets P housed in the sheet-supply cassette 4 will be provided while referring to FIG. 4.

At the lower edge of the sheet-supply cassette 4, a sheet-supply roller 11 elongated leftward and rightward is freely rotatably supported by a shaft on a body cover 2. A partial gear 12 and a cam plate 13 are attached to the left tip of the sheet-supply roller 11. The partial gear 12 includes a gearless portion **12*a*. The cam plate 13 includes a spring receiving cam 14 and a stop cam 15 formed integrally to each other. The stop cam 15 has an engaging portion 15*a*. A drive gear 9 engagable with the partial gear 12 is provided normally positioned at the gearless portion 12*a* of the partial gear 12. The drive gear 9 is driven in a predetermined rotation direction by a roller drive mechanism (not shown in the drawings). The drive gear 9 and the partial gear 12** form a partial gear mechanism.

Figure 2:
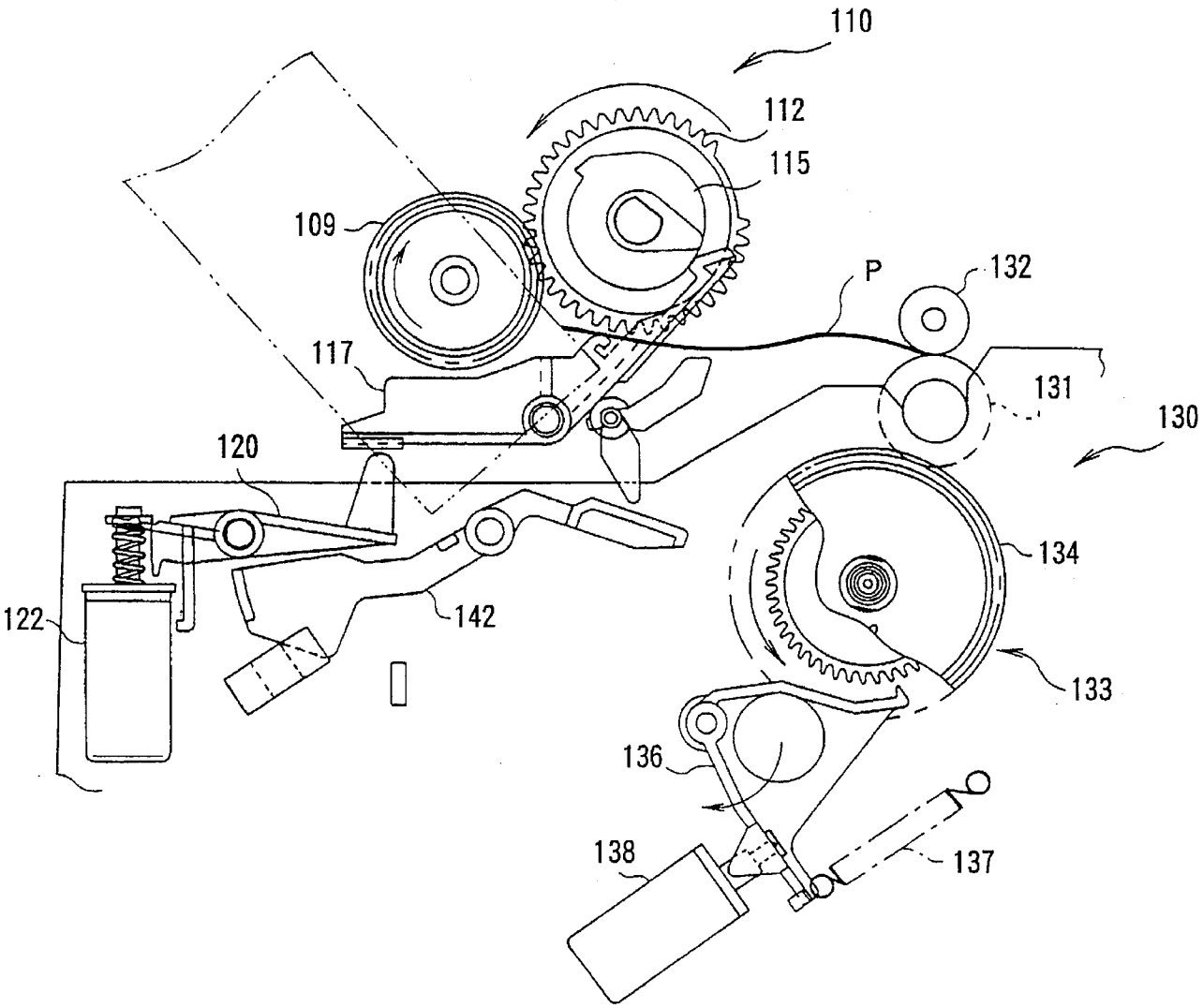
FIG. 2 is an enlarged schematic view showing a pair of resist rollers of the conventional sheet-supply mechanism of FIG. 1 aligning a supplied sheet.

A spring receiving cam 14 has a protruding shape in cross section. An edge of a coil spring 16 presses against the spring receiving cam 14. In the sheet-supply waiting condition shown in FIG. 4, the partial gear 12 is resiliently urged to rotate counterclockwise so that its engagement side faces the drive gear 9. Also, a stop lever 17 is swingably supported on a shaft on the body cover 2. The stop lever 17 has a stop portion **17*a* for engaging with the engaging portion 15*a* of the stop cam 15. A pulling spring 19 constantly resiliently urges the stop lever 17 to rotate counterclockwise so that the stop portion 17*a* is normally brought into engagement with than engaging portion 15*a*. Further, an input lever 20 is swingably supported on a side plate 3 on a support pin 21. The input lever 20 swings according to movement of a sheet-supply solenoid 22 to move the stop lever 17 from a stop position shown in FIG. 2 to a stop-release position shown in FIG. 3. The sheet-supply solenoid 22 for swinging, at timing of sheet-supply, the input lever 20 from the waiting position shown in FIG. 2 to the sheet-supply operation position shown in FIG. 3 is attached with an upright posture to the side plate 3**.

Next, an explanation of the resist roller mechanism 30 provided downstream of the sheet-supply mechanism 10 in the sheet-feed direction will be provided while referring to FIG. 4.

A first resist roller 31 is rotatably supported by a shaft on the side plate 3. A second resist roller 32 for pressing the first resist roller 31 from above is rotatably supported on the side plate 3. A transmission mechanism 33 includes a combination of a plurality of planetary gears (not shown in the drawings) and an output gear 34 provided adjacent to the resist roller mechanism 30. Although not shown in the drawings, a drive gear attached to the left end of the first resist roller 31 is engaged with the output gear 34. The first resist roller 31 receives and is driven to rotate by drive force from the transmission mechanism 33 via the output gear 34. The planetary gear (not shown in the drawings) of the transmission mechanism 33 are provided so that when an outer rotation gear 35 is prevented from rotating, the drive force received from the roller drive mechanism is transmitted to the output gear 34 so that the first resist roller 31 is driven, but when prevention of rotation of the rotation gear 35 is allowed to rotate, the drive force drives the rotation gear 35 without being transmitted to the output gear 34.

Further, a swing switch lever 36 having an engagement slat **36*a* engagable with the rotation gear 35 is swingably supported on a shaft to the side panel 3. The swing switch lever 36 is capable of switching from a transmission position shown in FIG. 4 to a non-transmission position shown in FIG. 8. A pulling spring 37 resiliently urges the swing switch lever 36 int the transmission position so that engaging slat 36*a* is urged toward engagement with the rotation gear 35**.

Next, an explanation of a sheet detection mechanism 40 for detecting presence and absence of a supplied recording sheet P will be provided while referring to FIG. 4. The sheet detection mechanism 40 is disposed between the sheet-supply mechanism 10 and the resist roller mechanism 30.

A sheet detection swing lever 41 is pivotably provided in the vicinity of a pivotal shaft 18 on which the stop lever 17 is mounted. The sheet detection swing lever 41 includes a sheet detection lever 41*a* and a operation lever 41*b* formed integrally to each other. A spring 41*c* urges the sheet detection lever 41 into the posture shown in FIG. 4 so that the sheet detection lever 41*a* protrudes upward into a sheet-supply pathway PP (see FIG. 3) taken by supplied recording sheets P. The operation lever 41*b* is formed integrally with and at substantially a right angle to the sheet detection lever 41*a*. A swing lever 42 is swingably supported on a support pin 43 directly beneath the stop lever 17. The swing lever 42 extends from the location of the input lever 20 to the location of the swing switch lever 36.

Figure 7:
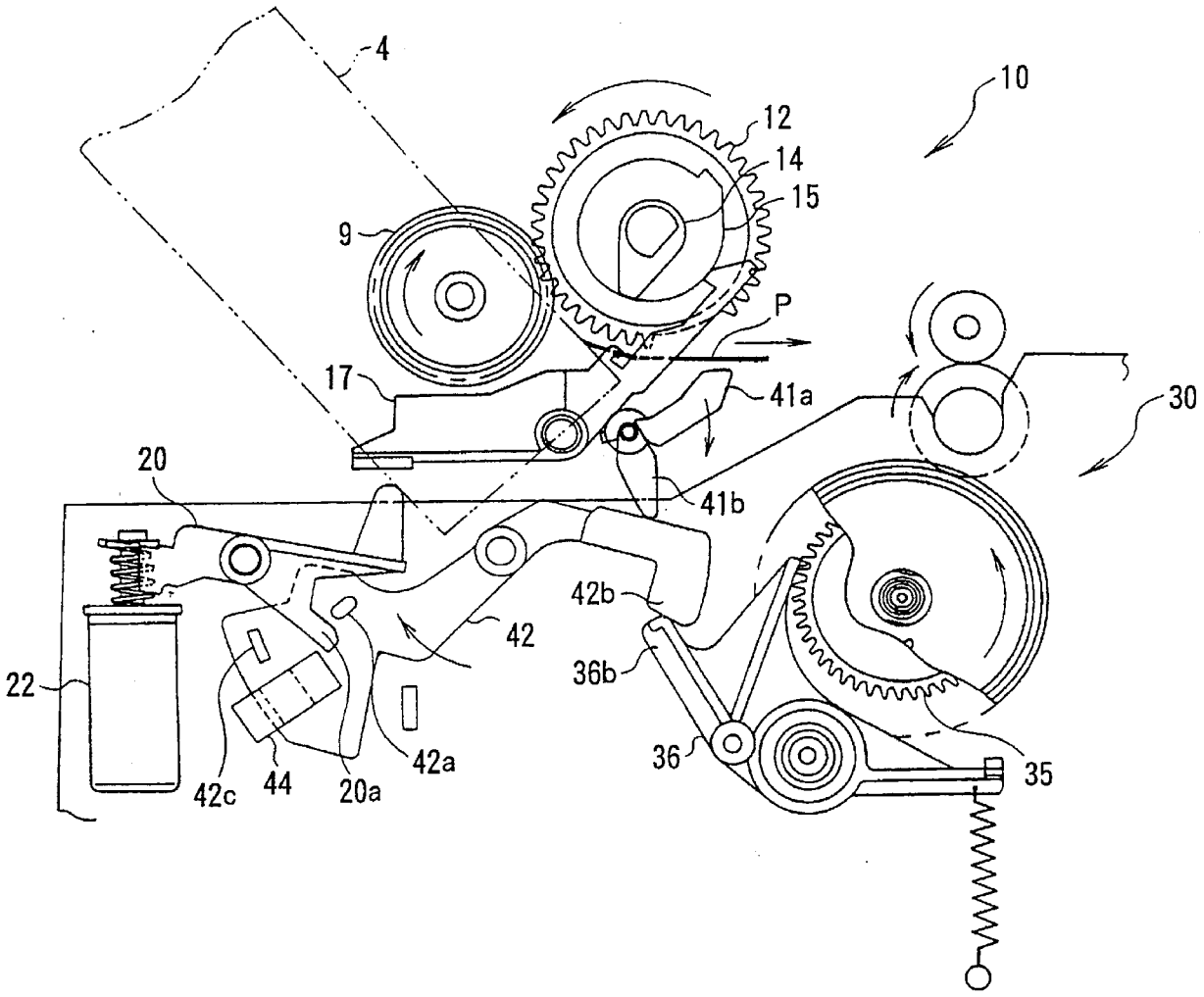
FIG. 7 is an enlarged schematic view showing the sheet-supply unit according to the first embodiment directly after start of sheet supply wherein a sheet-supply roller is driven by a drive gear.

When a recording sheet P is supplied, as shown in FIG. 7 the sheet detection lever 41*a* swings in the clockwise direction so that the sheet detection swing lever 41 pivots in the clockwise direction. The pressing force of the operation lever 41*b* swings the swing lever 42 from the waiting position shown in FIG. 4 to the sheet detection position shown in FIG. 7. It should be noted that, a protrusion 42*a* capable of engaging and disengaging with an engagement protrusion 20*a* formed in the input lever 20 is formed near the rear end of the swing lever 42. Also, an engagement protrusion 42*b* capable of engaging and disengaging with an engagement portion 36*b* formed in the swing switch lever 36 is formed at the front end of the swing lever 42.

That is, the protrusion 42*a* of the swing lever 42 and the engagement protrusion 20*a* of the input lever 20 comprise a first engagement mechanism and the engagement protrusion 42*b* of the swing lever 42 and the engagement portion 36*b* of the swing switch lever 36 comprise a second engagement mechanism.

A sheet detecting photointerupter 44 is provided in correspondence with the rear tip of the swing lever 42. After sheet-supply operations are started, the sheet detecting photointerupter 44 detects a detection protrusion 42*c* formed to the rear tip of the swing lever 42 to detect the presence or absence of a recording sheet P.

Next, an explanation of operations of the sheet-supply mechanism 10 and the resist roller mechanism 30 will be provided while referring to FIGS. 4 through 8.

First, when awaiting supply of a sheet, as shown in FIG. 4, the input lever 20 is in the waiting position 2, the stop lever 17 is in its stop position so that its stop portion 17*a* is engaged with than engaging portion 15*a* of the stop cam 15, and the drive gear 9 is driven to rotate in opposition to the gearless portion 12*a* of the partial gear 12. On the other hand, the swing switch lever 36 is in its transmission position so that its stop slat 36*a* is engaged with the rotation gear 35. As a result, both of the resistor rollers 31, 32 are driven to rotate by the output gear 34, which is rotated via the transmission mechanism 33.

Figure 5:
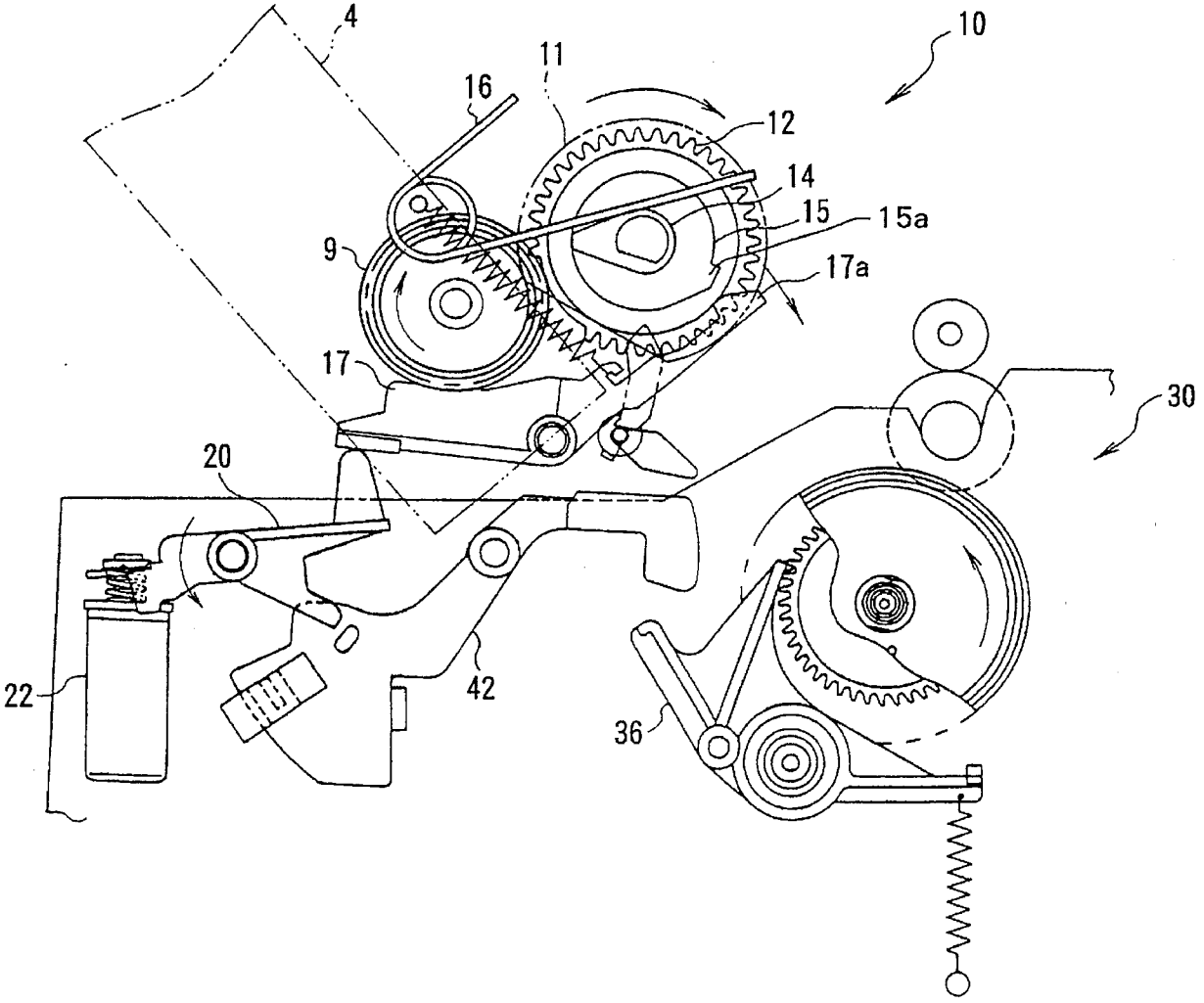
FIG. 5 is an enlarged schematic view showing the sheet-supply unit according to the first embodiment at start of sheet supply.
Figure 6:
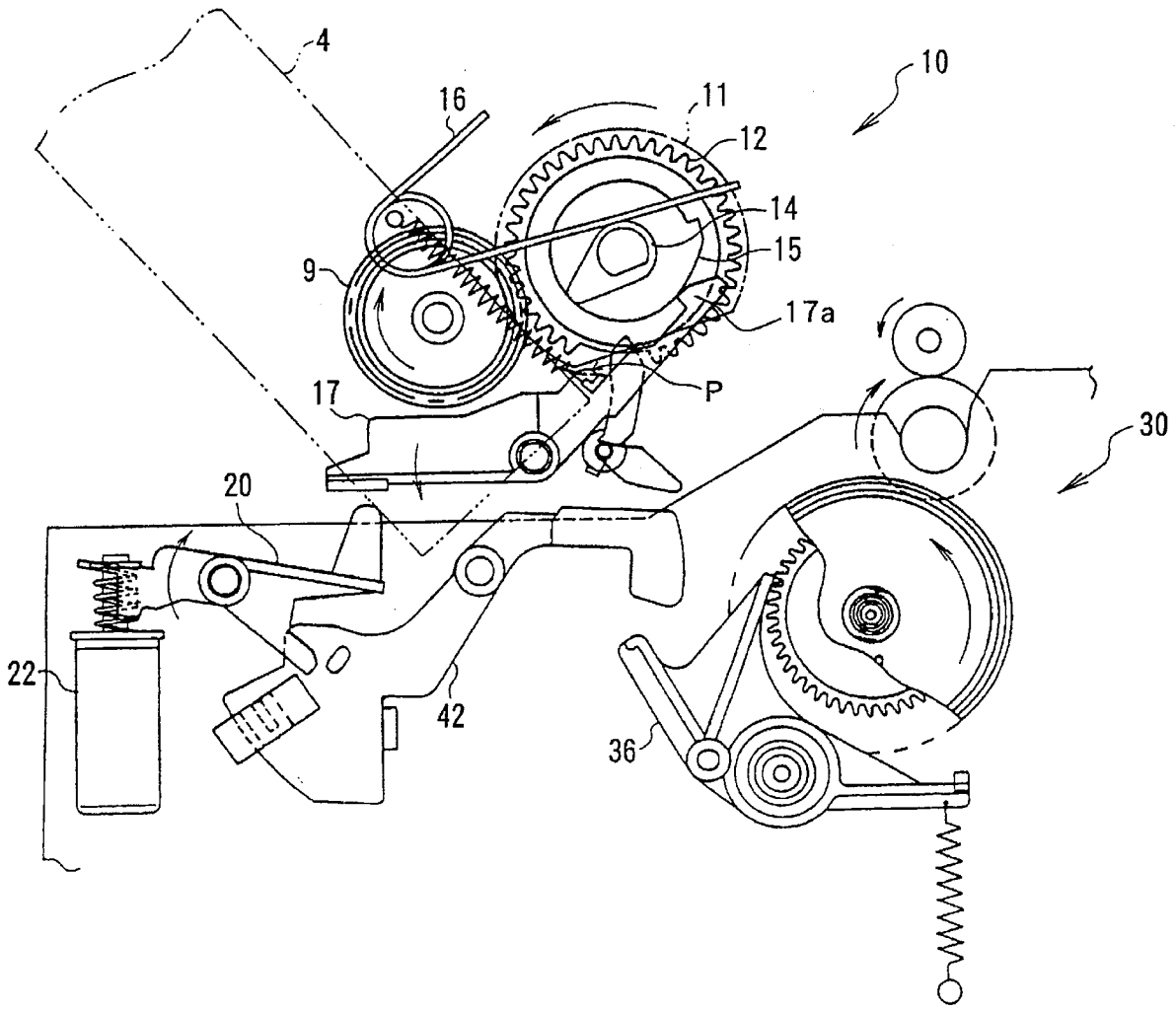
FIG. 6 is an enlarged schematic view showing the sheet-supply unit according to the first embodiment directly after start of sheet supply wherein a sheet-supply roller is driven by a drive gear.

When sheet-supply operations are performed, the sheet-supply solenoid 22 is driven for a short duration of time of, for example, one second. As a result, as shown in FIG. 5, the input lever 20 swings into its sheet-supply operation position and, in association with this, the stop lever 17 swings into its stop-release position. Therefore, the stop portion 17*a* is released from engagement with the engaging portion 15*a*. As a result, the spring receiving cam 14 follows the resilient urging force of the coil spring 16 so that the partial gear 12 rotates in the counterclockwise direction into engagement with the drive gear 9, whereupon the partial gear 12 is driven by the drive gear 9. The resultant rotation of the sheet-supply roller 11 supplies a recording sheet P from the sheet-supply cassette 4. Afterward, drive of the sheet-supply solenoid 22 is stopped so that, as shown in FIG. 6, the input lever 20 returns to its original waiting position and the stop portion 17*a* returns to its original engagement position, although at this time the stop portion 17*a* merely follows the outer surface of the stop cam 15 without engaging with the engaging portion 15*a*.

As shown in FIG. 7, the front edge of the initially supplied recording sheet P swings the sheet detection lever 41*a* in the clockwise direction. In association with this, the sheet detection swing lever 41 simultaneously swings in the clockwise direction. Pressure from the operation lever 41*b* reliably swings the swing lever 42 into its sheet detection position. This moves the protrusion 42*a* into a position were it can engage with the engagement protrusion 20*a* of the input lever 20. Also, the engagement protrusion 42*b* moves into an engagable position wherein it is engagable with the swing switch lever 36.

Figure 8:
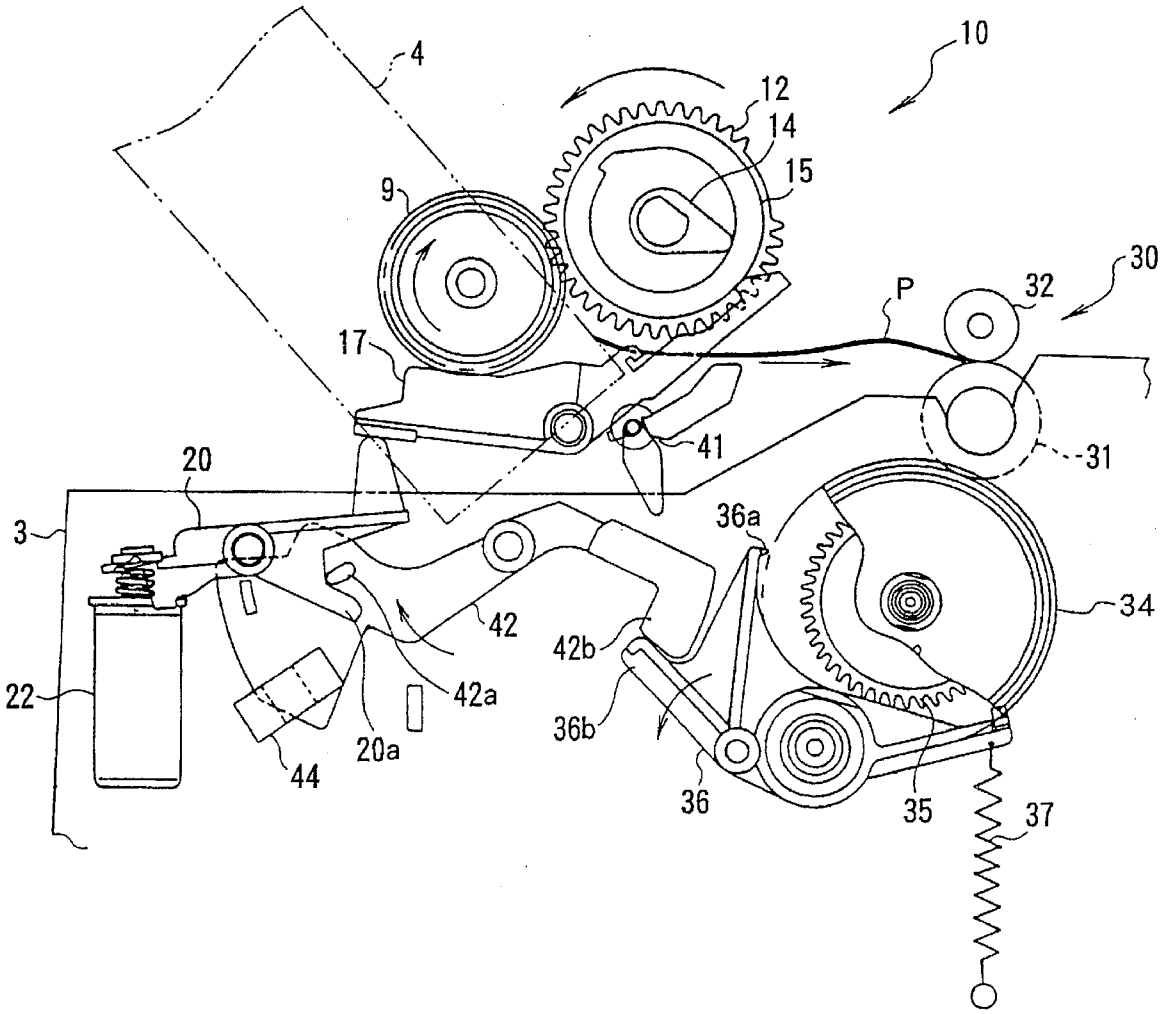
FIG. 8 is an enlarged schematic view showing the sheet-supply unit according to the first embodiment when a pair of resist rollers align a supplied sheet.

Further, at a predetermined timing directly after start of sheet-supply operations as shown in FIG. 8, that is, when the front edge of the recording sheet P reaches directly in front of the pair of resist rollers 31, 32, the sheet-supply solenoid 22 is again driven a short duration of time of, for example, about 0.2 to 0.5 seconds. At this time, engagement between the protrusion 42*a* and the engagement protrusion 20*a* pivots the swing lever 42 in the clockwise direction to a predetermined angle. Therefore, the engagement protrusion 42*b* engages in the engagement portion 36*b* of the swing switch lever 36 and moves the engagement portion 36*b* downward a predetermined distance. This causes the swing switch lever 36 to swing in the counterclockwise direction into its non-transmission position, thereby allowing rotation of the rotation gear 35.

As a result, the drive force received from the roller drive mechanism is no longer transmitted to the output gear 34 so that the resist rollers 31, 32 are not driven for the short duration of time. Therefore, the front edge of the recording sheet P is stopped and aligned by the resist rollers 31, 32.

However, immediately afterward, drive of the sheet-supply solenoid 22 is stopped so that the swing switch lever 36 immediately returns to its original transmission position and drive of both the resistor rollers 31, 32 starts again. The recording sheet P is therefore supplied toward the scanner unit 60 with its front edge properly aligned. The recording sheet P is then printed on.

In this way, by providing the swing lever 42 of the sheet detection mechanism 40 to serve as a connection swing lever for connecting and releasing the input lever 20 of the sheet-supply mechanism 10 and the swing switch lever 36 of the resist roller mechanism 30, when the sheet-supply solenoid 22 provided to the sheet-supply mechanism 10 is operated a second time for a short duration of time at a predetermined timing directly after start of sheet-supply operations, then the swing lever 42 is swung by the input lever 20, the swing switch lever 36 temporarily switches to its non-transmission position, and the resist roller mechanism 30 is temporarily brought into its non-transmission condition. The pair of resist rollers 31, 32 temporarily stop rotating, thereby stopping and aligning the recording sheet P. This is possible without providing a separate connection swing lever and without providing an electromagnetic actuator in the resist roller mechanism 30. Also, costs of the laser printer 1 can be reduced and assembly operations can be simplified.

Because a sheet detection swing lever 41 provided to the connection mechanism is caused by a supplied sheet P to swing the connection swing lever 42 to a predetermined angle, wherein it can engage with the input lever 20 and the swing switch lever 36, the connection swing lever 42 can be accurately swung into a position wherein it is engagable with the input lever 20 and the swing switch lever 36 even if the connection swing lever 42 is long and large. Also, when the sheet P passes the sheet detection swing lever 41, sheet detection swing lever 41 is urged back into its original posture by the sring 41*c*, thereby allowing the connection swing lever 42 to return to its original posture. Therefore, even if the input lever 20 is again operated to supply a successive sheet P, the interval between sheets P during consecutive sheet feed can be reduced without stopping the resistor rollers 31, 32 and influencing the sheet P presently being transported by the resistor rollers 31, 32.

Because, the swing lever 42 is included in a sheet detection mechanism 40 for detecting the presence and absence of a sheet P downstream from the sheet-supply mechanism in the sheet-feed direction, a separate connection swing lever need not be provided solely for connecting operation of the input lever 20 with that of the swing switch lever 36.

Because a first engagement mechanism 42*a*, 20*a* is provided capable of engaging and disengaging one end of the connection swing lever 42 with the input lever 20, and because a second engagement mechanism 42*b*, 36*b* is provided capable of engaging and disengaging the other end of the connection swing lever 46 with the swing switch lever 36, therefore, when the connection swing lever swings into its connection posture, the first engagement mechanism 42*a*, 20*a* ensures reliable engagement between the end of the connection swing lever 42 and the input lever 20 and the second engagement mechanism 42*b*, 36*b* ensures reliable engagement between the other end of the connection swing lever 42 and the swing switch lever 36.

It should be noted that, the sheet-supply mechanism 10 could have any of a variety of configurations having sheet-supply rollers, a sheet-supply solenoid, and other components. Also, the resist roller mechanism 30 could have any of a variety of configurations having a pair of resist rollers, a transmission mechanism, and other components. Also, the a variety of levers could be used instead of the swing lever 42. Also, the present invention could be applied to a variety of image forming device, such as copy machines and facsimile machines.

Figure 9:
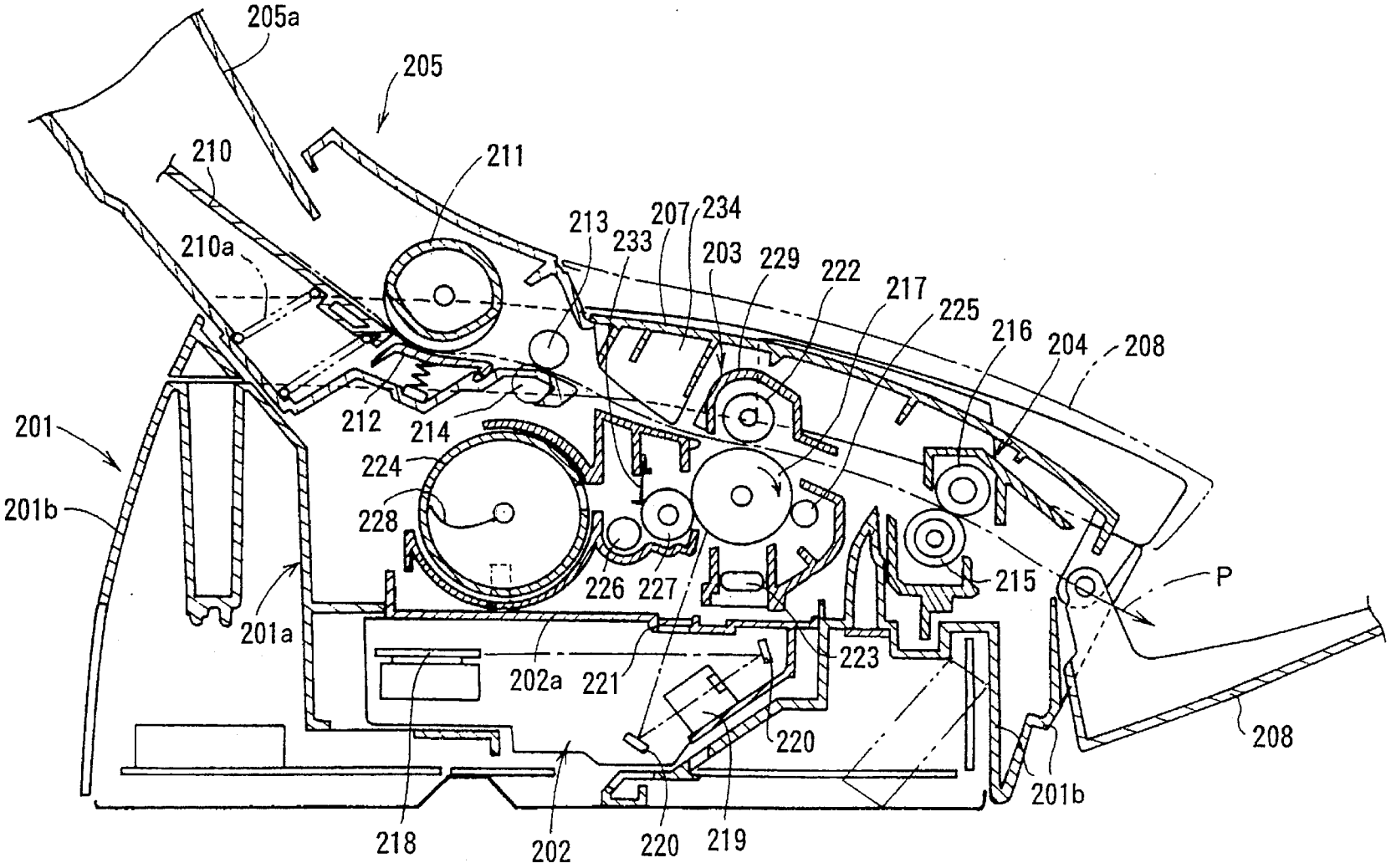
FIG. 9 is a cross-sectional view showing a laser printer to which a sheet-supply unit according to a second embodiment of the present invention is applied.

Next, an explanation of a laser beam printer according to a second embodiment of the present invention will be provided while referring to FIGS. 9 through 19 (*b*). FIG. 9 is a schematic cross-sectional view of the laser printer, which serves as an image forming device. As shown in FIG. 9, a printer main case 201 includes a main frame 201*a* and a main cover body 201*a*, both formed from a compound resin. The main frame 201*a* is for mounting, from above, a scanner unit 202, a process unit 203, a fixing unit 204, and a sheet-supply unit 205. The main cover 201*b* is for covering the four (that is, front, rear, left, and right) outer surfaces of the main frame 201*a*.

A compound resin top cover 207 is provided for covering the upper surface of the main frame 201*a* and the main cover 201*b*. Although not shown in the drawings, brackets are provided with an upright orientation to the left and right sides at the front edge of the top cover 207. A base of a discharge tray 208 is mounted to the brackets so that the discharge tray 208 is pivotable upward and downward. When not needed, the discharge tray 208 can be folded up against the upper side of the top cover 207.

A stack of sheets P are set in a feeder case 205*a* in the sheet-supply unit 205. A support plate 210 including an urging spring 210*a* is provided in the feeder case 205*a*. A substantially half-moon shaped sheet-supply roller 211 is provided in confrontation with the support plate 210. The support plate 210 presses the front edge of a set sheet P against the sheet-supply roller 211. The sheet-supply roller 211 is rotated by rotational power transmitted from a drive system (to be described later). One sheet P at a time is separated by the rotating sheet-supply roller 211 and a separation pad 212. The separated sheet P is transported to a process unit 203 by a pair of upper and lower resist rollers 213, 214. The process unit 203 forms a toner image on the surface of the sheet P. A thermal roller 215 and a pressing roller 216 of the fixing unit 204 fix the toner image to the sheet P. Afterward the sheet P is discharged onto the discharge tray 208.

The scanner unit 202 serves as an exposure unit and includes a laser emitting portion, a polygon mirror 218, a lens 219, and a reflection mirror 220, all disposed to a lower surface of a compound plastic support plate 202*a*. A photosensitive drum 217 is provided to the process unit 203. A rectangular scanner hole elongated following an axial line of the photosensitive drum 217 is opened in the upper plate 202*a*. A glass plate 221 covers the scanner hole. The scanner unit 202 produces a laser beam that passes through the glass plate 221 toward the photosensitive drum 217. The laser beam irradiates and exposes the outer surface of the photosensitive drum 217.

The process unit 203 includes the photosensitive drum 217; a transfer roller 222 in abutment with the photosensitive drum 217; a charger 223, such as a scorotoron type charger, positioned beneath the photosensitive drum 217; a developer device including a develop roller 227 and a supply roller 226 disposed upstream from the photosensitive drum 217 in the sheet-supply direction, a developing agent (toner) supply portion, that is, a detachable toner cartridge 224 disposed upstream from the developer device; and a cleaning device 225 disposed downstream from the photosensitive drum 217. The charger 223 forms a charge layer on the outer peripheral surface of the photosensitive drum 217. Scanning the laser beam from the scanner unit across the outer peripheral surface of the photosensitive drum 217 forms a latent static image thereon. An agitator 228 agitates developing agent (toner) in and releases it from the toner cartridge 224. The released toner is borne on the outer peripheral surface of the develop roller 227 via the supply roller 226. A blade 233 regulates the thickness of the toner layer on the develop roller 227. The developing agent from the develop roller 227 clings to and develops the latent static image on the photosensitive drum 217. The developed toner image is transposed onto a sheet P passing between the transfer roller 222 and the photosensitive drum 217. Then, residual toner on the photosensitive drum 217 is recovered by the cleaning device 225.

The process unit 3 is provided in a cartridge form and is assembled in a compound resin case 229. The cartridge process unit 203 is detachably mounted to the main frame 201*a*.

It should be noted that a rib 234 is provided with a downward-facing orientation to the under surface of the compound resin top cover 207 to form a chute for sheets P. The rib 234 is positioned over the transport pathway taken by a sheet P from the pair of resist rollers 213, 214 to the transfer roller 222 in the process unit 22.

Figure 10:
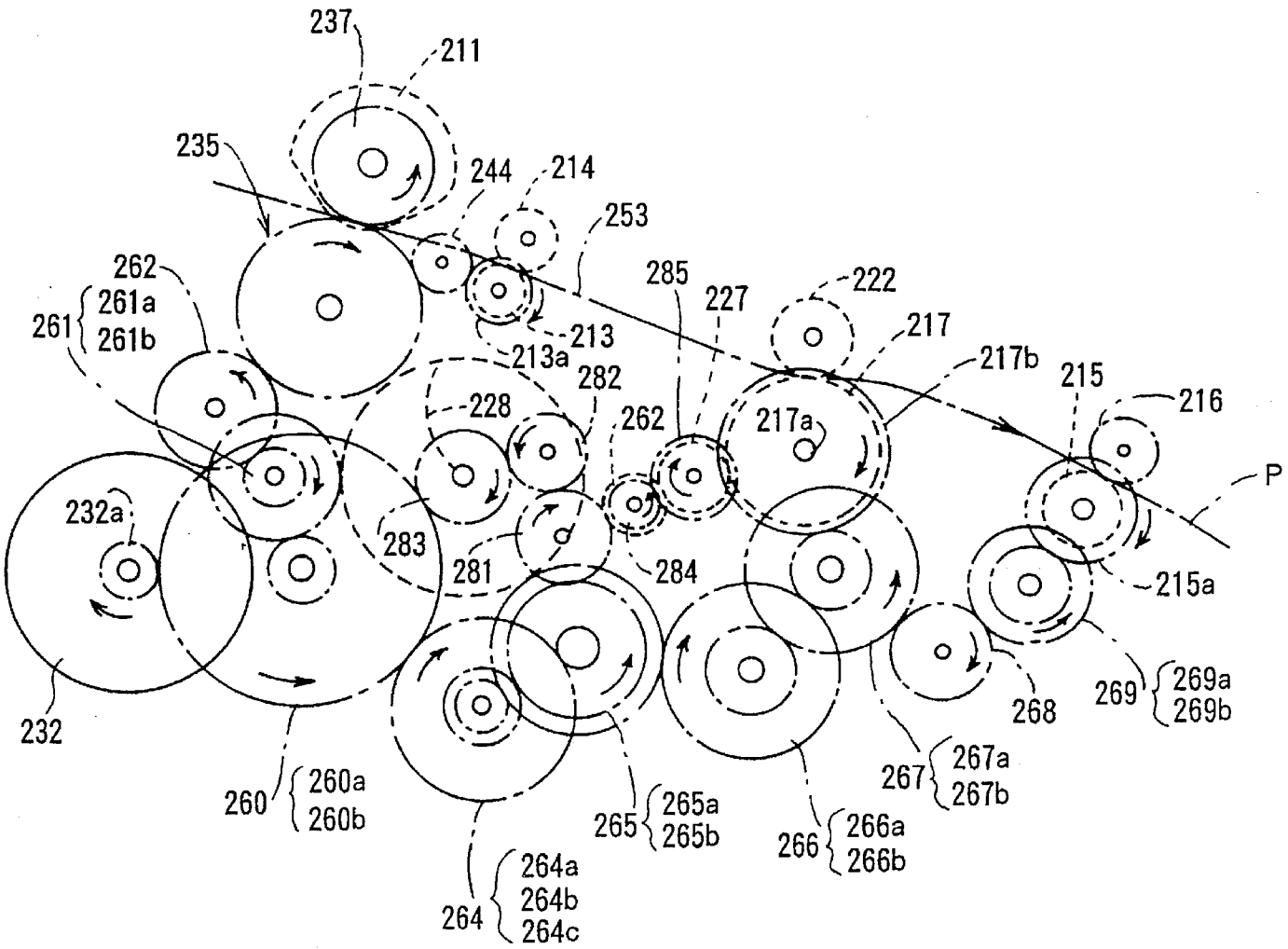
FIG. 10 is a schematic view showing a gear train of the sheet-supply unit according to the second embodiment.

FIG. 10 shows configuration of a drive system for gear trains of the various units described above. A drive motor 232 having a pinion gear 232*a* is capable of rotating in a forward and a reverse direction. Resultant rotation force of the pinion gear 232*a* is transmitted to the substantially half-moon shaped sheet-supply roller 211 of the sheet-supply unit 205 via a two-level gear 260 (260*a*, 260*b*), a two-level gear 261 (261, 261*b*), a gear 262, and a gear transmission mechanism 235 (to be described later).

Rotation force of the two-level gear 260 (260*a*, 260*b*) is transmitted to a gear 217*a* of the photosensitive drum 217 via a three-level gear 264 (264*a*, 264*b*, 264*c*), a two-level gear 265 (265*a*, 265*b*), a two-level gear 266 (266*a*, 266*b*), and a two-level gear 267 (267*a*, 267*b*). Further, the rotation force of the two-level gear 267 (267*a*, 267*b*) is transmitted to a gear 215*a* of the thermal roller 215 of the fixing unit 204 via a gear 268 and a two-level gear 269 (269*a*, 269*b*).

On the other hand, the rotation power of the two-level gear 265 (265*a*, 265*b*) is transmitted to the agitator 228 via gears 281, 282, and 283 and to the supply roller 226 and the develop roller 227 via gears 281, 284, and 285.

Figure 11:
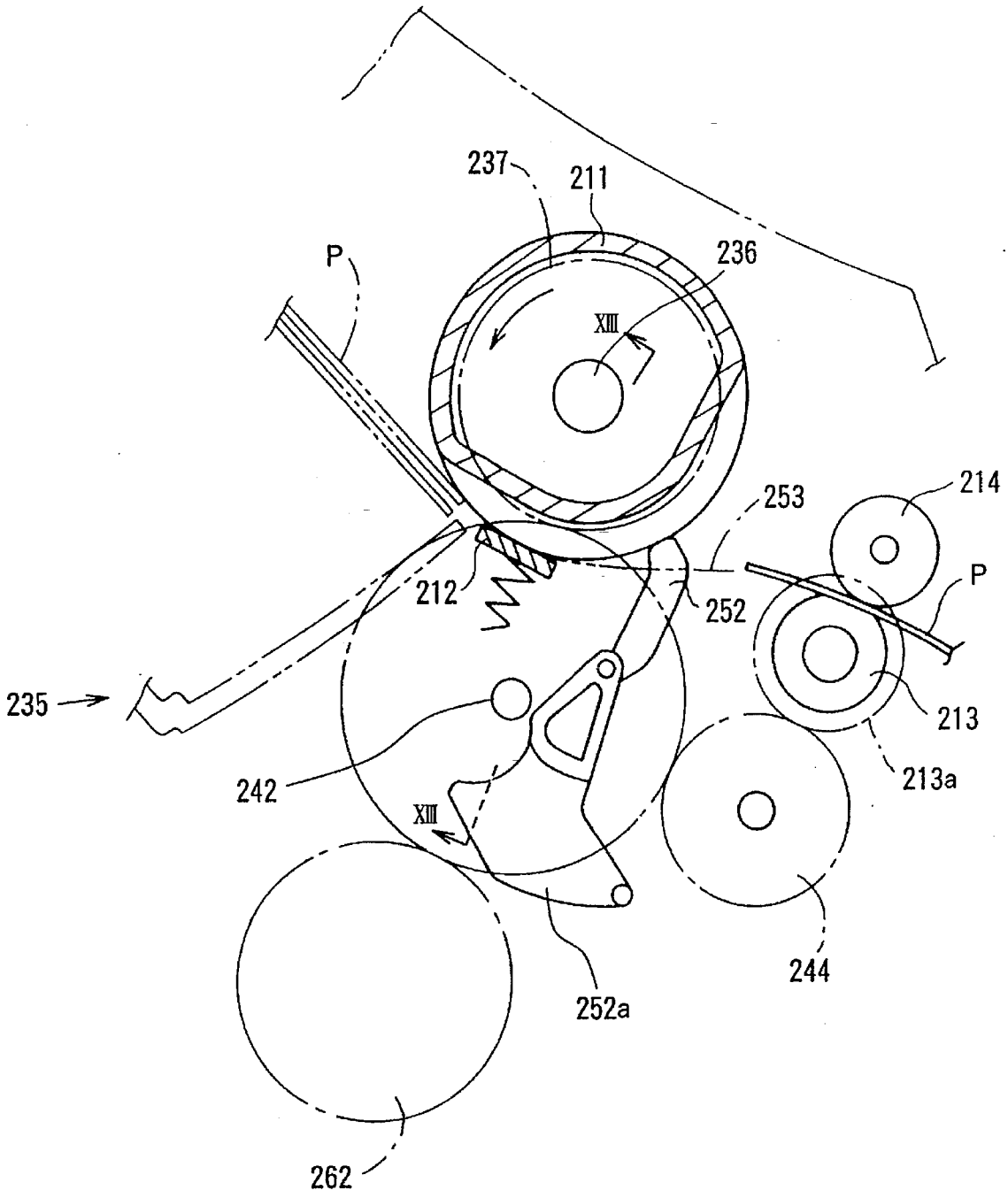
FIG. 11 is an enlarged schematic side view showing the sheet-supply unit according to the second embodiment.
Figure 12:
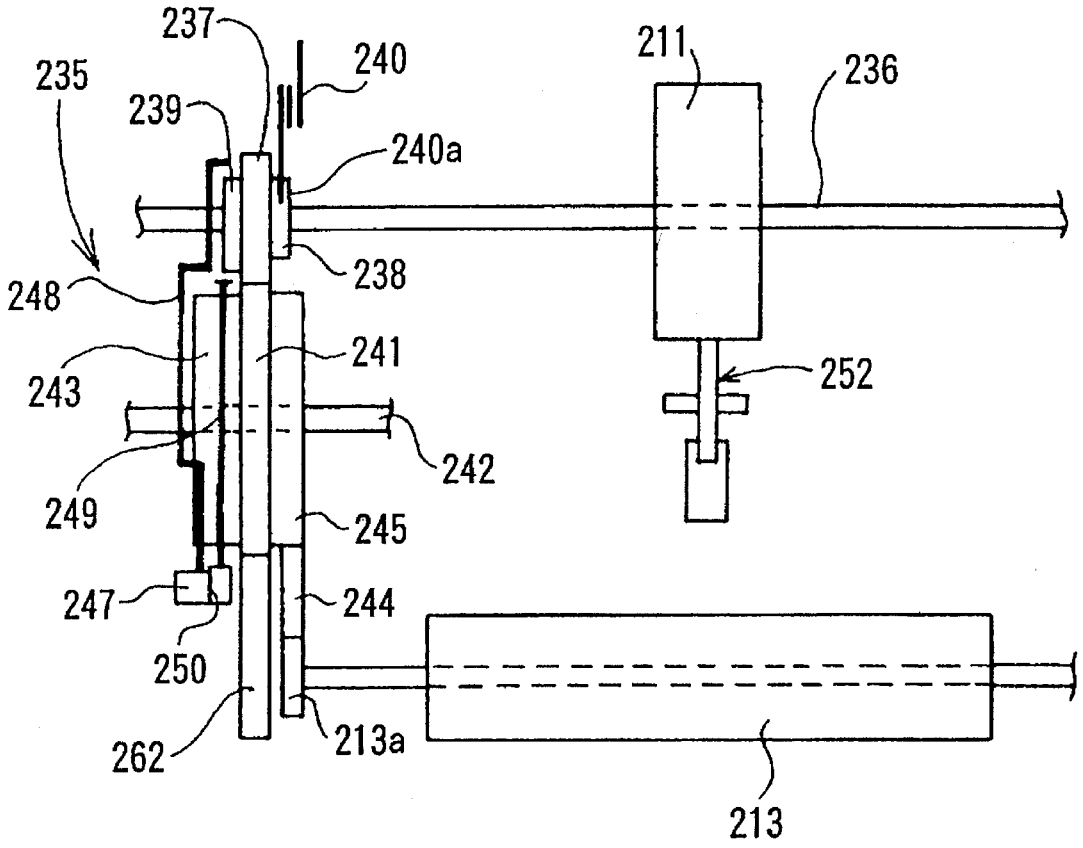
FIG. 12 is an enlarged schematic plan view showing the sheet-supply unit according to the second embodiment.

Next, a detailed explanation of the gear power transmission mechanism 235, which is a mechanism for transmitting power to the sheet-supply unit 205 and the resist roller 213, will be provided while referring to FIGS. 11 through 19 (*b*). As shown in FIG. 12, the gear power transmission mechanism 235 includes an input gear 241, a resist clutch 243, a transport gear 245, a first lever 248, a second lever 249, and a common coil spring 250.

Figure 15:
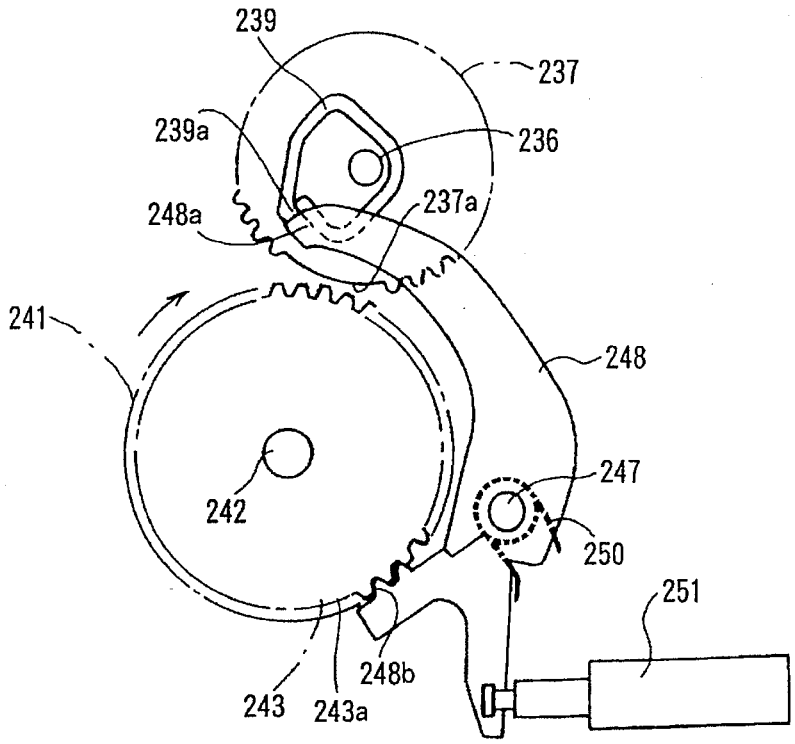
FIG. 15 (*a*) is a schematic side view showing positional relationship between a first lever and other components of the gear power transmission mechanism during a sheet-supply waiting period.
Figure 15:
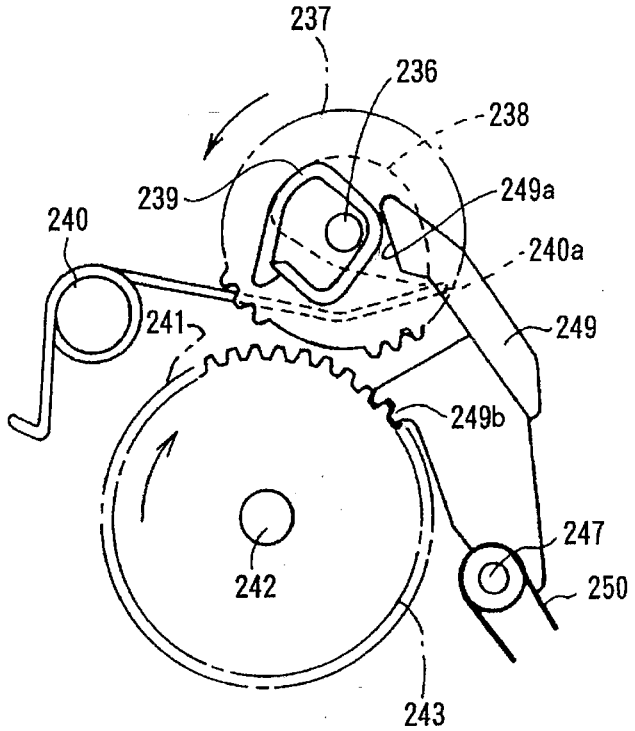

As shown in FIG. 11, a partial gear 37 is fixed on the same shaft 236 as the sheet-supply roller 211. As shown in FIG. 12, a spring receiving cam 238 and a stop cam 239 are integrally formed to the left and right sides of the partial gear 237. A tip portion 240*a* of a coil spring 240 urgingly presses against the outer peripheral cam surface of the spring receiving cam 238 as best seen in FIG. 15 (*b*). This urges the partial gear 237 to rotate counterclockwise as viewed in FIG. 15 (*b*) toward engagement with the input gear 241, which is rotated by the gear 262, which is at the drive side of the gear train mechanism.

Figure 13:
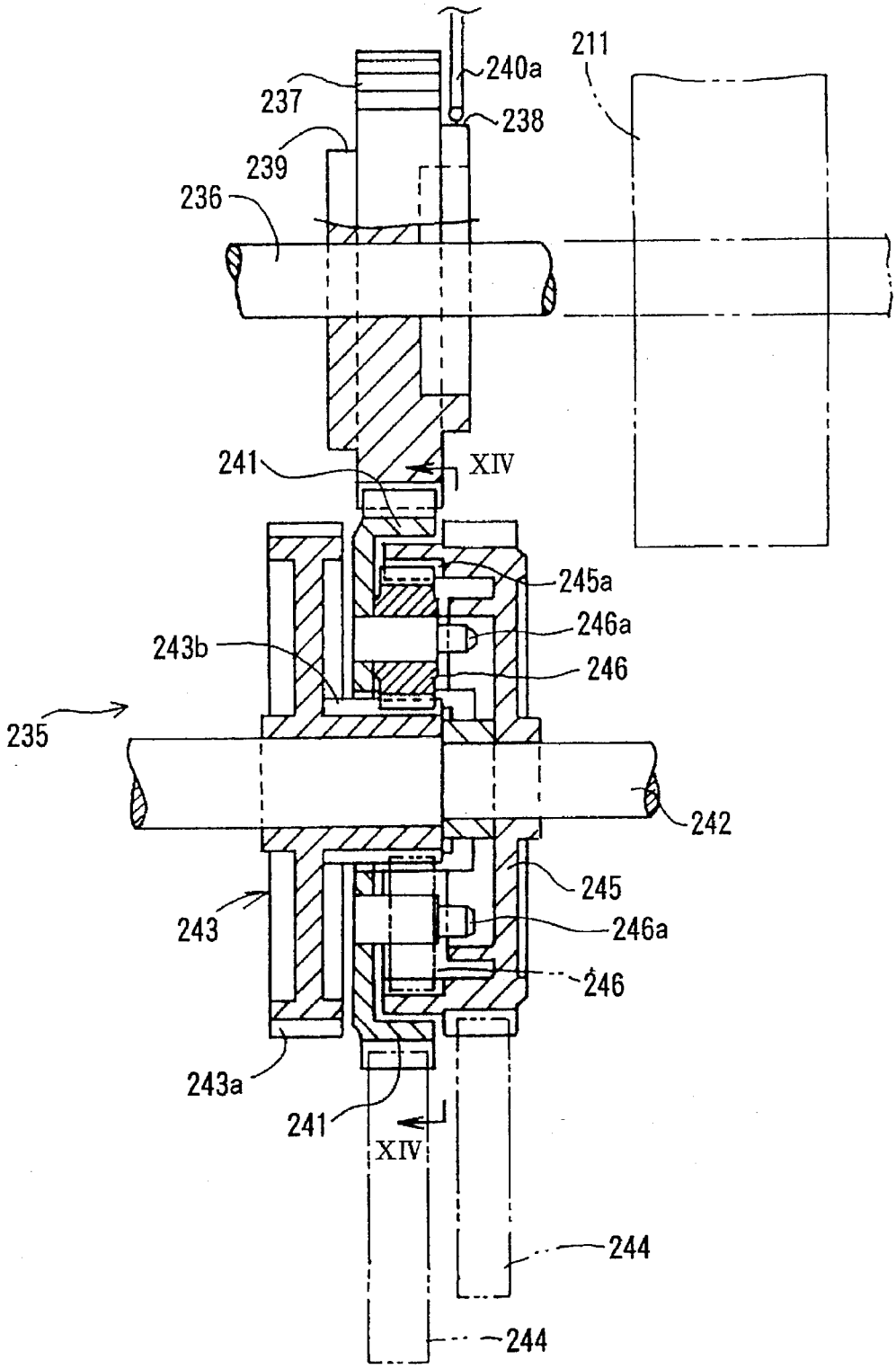
FIG. 13 is an enlarged view in partial cross section taken along line XIII—XIII of FIG. 11 showing the sheet-supply unit according to the second embodiment.

The input gear 241 is freely rotatably supported on a shaft 242 and is constantly driven to rotate by the drive gear 262 during sheet-supply operations. As shown in FIG. 13, the resist clutch 243 includes a large-diameter gear portion 243*a* and a small-diameter gear portion 243*b* and is rotatably supported on the shaft 242 adjacent to the input gear 241. The transport gear 245 is rotatably supported on the shaft 242 on the opposite side of the resist clutch 243 so as to sandwich the input gear 241 between itself and the resist clutch 243. Power is transmitted from the transport gear 245 to the gear 213*a* of the resist roller 213 via an intermediate gear 244.

Figure 14:
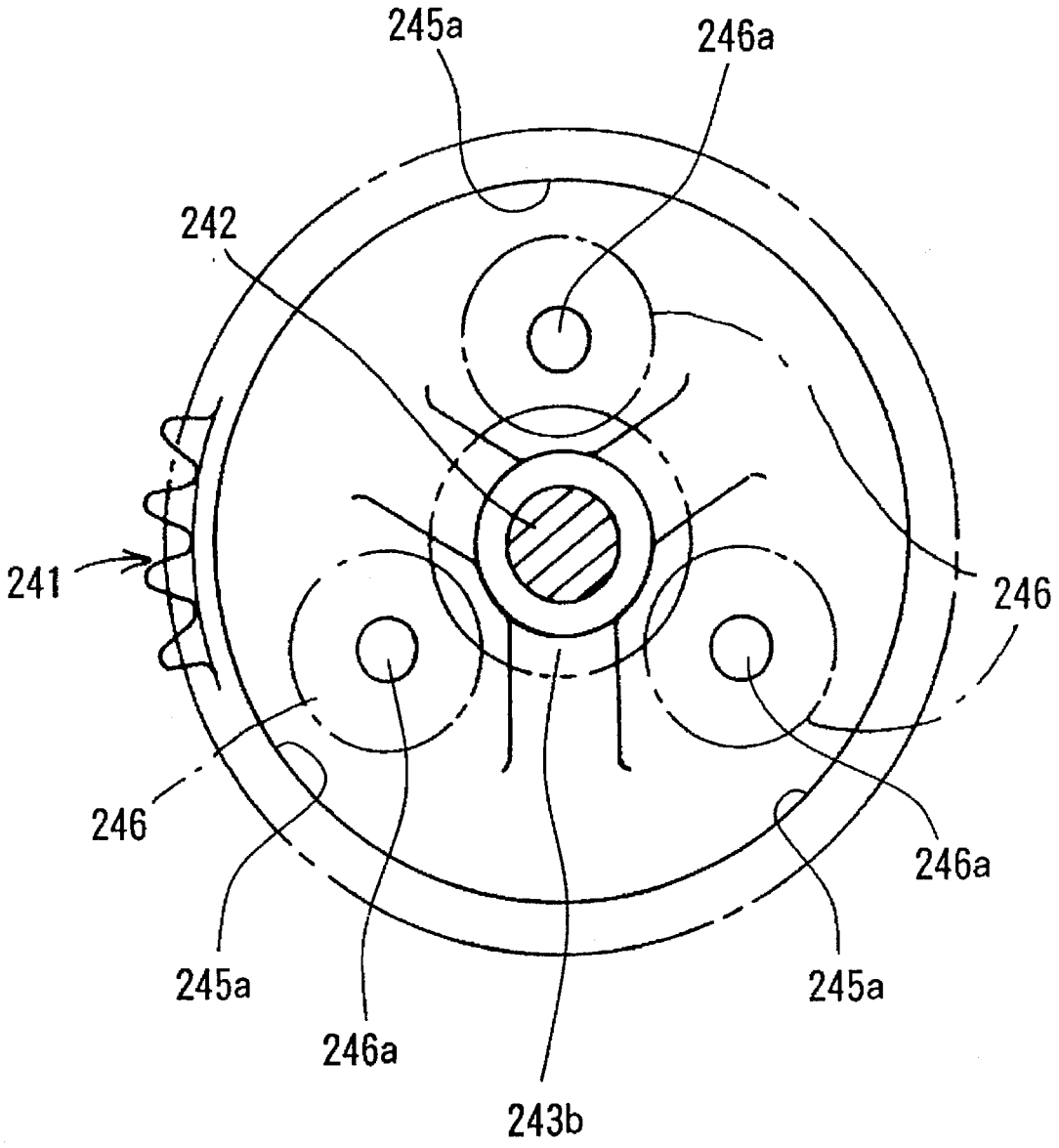
FIG. 14 is an enlarged cross-sectional view taken along line XIV—XIV of FIG. 13 showing an input gear and planetary gears of a gear power transmission mechanism.

As shown in FIGS. 13 and 14, a plurality of self-rotatable planetary gears 246 are supported on the side surface of the input gear 241. The planetary gears 246 are all meshingly engaged with both the small-diameter gear portion 243*b* of the resist clutch 243 and an inner diameter gear portion 245*a* of the transport gear 245. With this configuration, when rotation of the resist clutch 243 is prevented during sheet-supply operations, the transport gear 245 rotates to drive rotation of the resist roller 213 but, when the resist clutch 243 is allowed to rotate during sheet-supply operations, the transport gear 245 does not rotate so that the resist roller 213 stops.

As shown in FIG. 12, a shaft 247 is disposed near the outer peripheral surface of the resist clutch 243. A first lever 248 and a second lever 249 are disposed adjacent to each other on the shaft 247. A common coil spring 250 serving as a common urging means is disposed between the first lever 248 and the second lever 249. As shown in FIGS. 15 (*a*) and 15 (*b*), the common coil spring 250 urges a cam engaging portion 248*a* at the tip of the first lever 248 into meshing engagement with a stop portion 239*a* of the stop cam 239 and at the same time urges an abutment portion 249*a* at the tip of the second lever 249 into pressing abutment with the outer peripheral surface of the stop cam 239.

Figure 16:
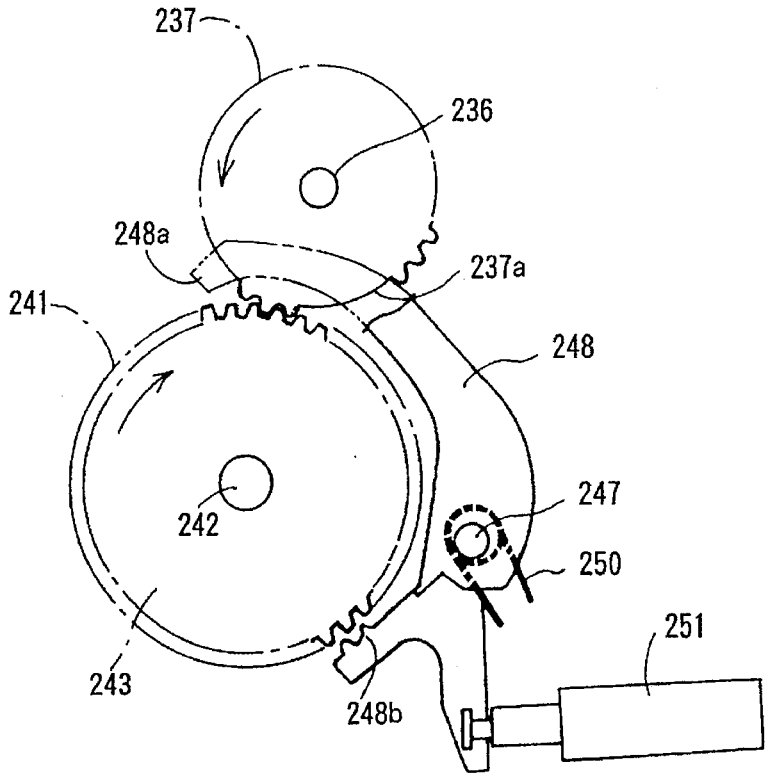
FIG. 16 (*a*) is a schematic side view showing the first lever and other components of the gear power transmission mechanism during a sheet-supply operations.
Figure 16:
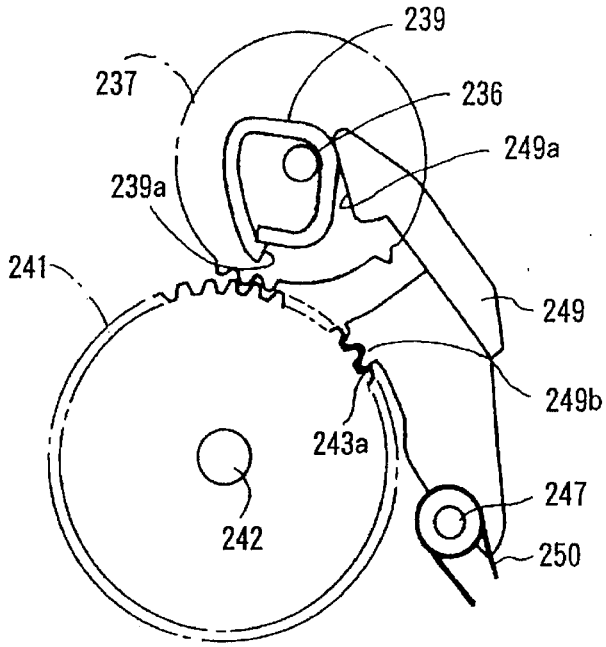

A first resist clutch engagement portion 248*b* capable of meshingly engaging with the large-diameter gear portion 243*a* of the resist clutch 243 is provided to the base end of the first lever 248. An electromagnetic solenoid 251 serving as an actuator is connected to the base end of the first lever 248. When as shown in FIGS. 16 (*a*) and 16 (*b*) the electromagnetic solenoid 251 is turned ON, the cam engaging portion 248*a* separates from the stop portion 239*a* of the stop cam 239 so that the cam engaging portion 248*a* and the stop portion 39*a* are released from meshing engagement with each other and the first resist engagement portion 248*b* is released from engagement with the large-diameter gear portion 243. Alternatively, while the cam engaging portion 248*a* is in an engaged condition with respect to the stop portion 239*a* of the stop cam 239, the first resist engagement portion 248*b* is in an engaged condition with respect to the large-diameter gear portion 243*a*.

Further, a protruding second engagement portion 249*b* is provided at an intermediate position of the second lever 249. When the second lever 249 is pivoted by the tip abutment portion 249*a* in correspondence with rotation phase of the stop cam 239, in association with this, the second engagement portion 249*b* meshingly engages with and disengages from the large-diameter gear portion 243*a*.

As shown in FIG. 11, a pendulum-type sheet sensor 252 with a heavy base end 252*a* is rotatably disposed along the sheet transport pathway 253 between the sheet-supply roller 211 and the pair of resist rollers 213, 214. When a sheet P passes the sheet sensor 252, the front edge of the sheet P presses against the sheet sensor 252 to pivot it in the clockwise direction. At this time, a photo-interrupt type sensor portion (not shown in the drawings) outputs a front edge sensing signal. In the same manner, when the end edge of the sheet P passes the location of the sheet sensor 252, the sheet sensor 252 pivots in the counterclockwise direction and the sensor portion outputs an end edge sensing signal.

Next, an explanation of sheet-supply operations and resist operations will be provided. In the following explanation, it will be assumed that the input gear 241 is constantly rotating. FIG. 15 (*a*) shows orientation of the first lever 248 during a sheet-supply waiting condition. In the same way, FIG. 15 (*b*) shows orientation of the second lever 249 during the sheet-supply waiting condition. In this condition, the cam engaging portion 248*a* of the first lever 248 holds the stop portion 239*a* of the stop cam 239 in a position wherein a toothless portion 237*a* of the partial gear 237 opposes the toothed surface of the input gear 241. Also, the coil spring 240 urges the partial gear 237 toward engagement with the input gear 241. Moreover, the first resist clutch engagement portion 248*b* of the first lever 248 meshingly engages the large-diameter gear portion 243*a* of the resist clutch 243. On the other hand, the tip abutment portion 249*a* of the second lever 249 is urged by the common coil spring 250 into pressing abutment with a small diameter portion of the stop cam 239. Also, the second engagement portion 249*b* engages with the large-diameter gear portion 243*a* of the resist clutch 243, thereby stopping, or locking, the resist clutch 243. Further, rotation of the sheet-supply roller 211 is stopped with a small-diameter portion of the sheet-supply roller 211 opposing the separation pad 212.

Accordingly, although the input gear 241 rotates, its rotation power is not transmitted to the partial gear 237 so that the sheet-supply roller 211 is maintained in the stopped condition, resulting in operations for removing a sheet from the sheet-supply unit 205 not being performed. On the other hand, rotation force of the input gear 241 is transmitted to the transport gear 245 via the planetary gears 246 so that the resist roller 213 is rotated. Therefore, any sheet P sandwiched between the pair of resistor rollers 213, 214 is transported toward the process unit 23.

Next, when a sheet-supply command is inputted to the laser printer, and also the end edge of a preceding sheet P is detected by the sheet sensor 252, then sheet-supply operations for a next sheet P are started. FIG. 16 (*a*) shows orientation of the first lever 248 at the start of the sheet-supply operation. In the same manner, FIG. 16 (*a*) shows orientation of the second lever 249 at the start of the sheet-supply operation. FIG. 11 shows the orientation of the sheet-supply roller 211 in this condition.

At start of the sheet-supply operation, the electromagnetic solenoid 251 is turned ON (excited) for a short time of, for example, 0.2 seconds so that the operation shaft of the electromagnetic solenoid 251 is drawn in. The cam engaging portion 248*a* at the tip of the first lever 248 separates from the stop portion 239*a* of the stop cam 239. Following the urging of the coil spring 240, the toothed portion of the partial gear 237 meshingly engages with the input gear 241. The large diameter portion of the sheet-supply roller 211 rotates in the counterclockwise direction while abutting the upper surface of the uppermost sheet P in the stack. (Refer to FIG. 11.) Although at this time the first resist clutch engagement portion 248*b* of the first lever 248 is released from engagement with the large-diameter gear portion 243*a* of the resist clutch 243, because the second engagement portion 249*b* of the second lever 249 is maintained in engagement with the large-diameter gear portion 243*a* as shown in FIG. 16 (*b*), the resist clutch 243 is maintained in its locked condition where it does not rotate. Therefore, the rotation of the transport gear 245 and the resist roller 213 continues so that transport of the preceding sheet P continues. When the electromagnetic solenoid 251 is turned back OFF, the first resist clutch engagement portion 248*b* of the first lever 248 and the large-diameter gear portion 243*a* of the resist clutch 243 again fall into engagement with each other.

Figure 17:
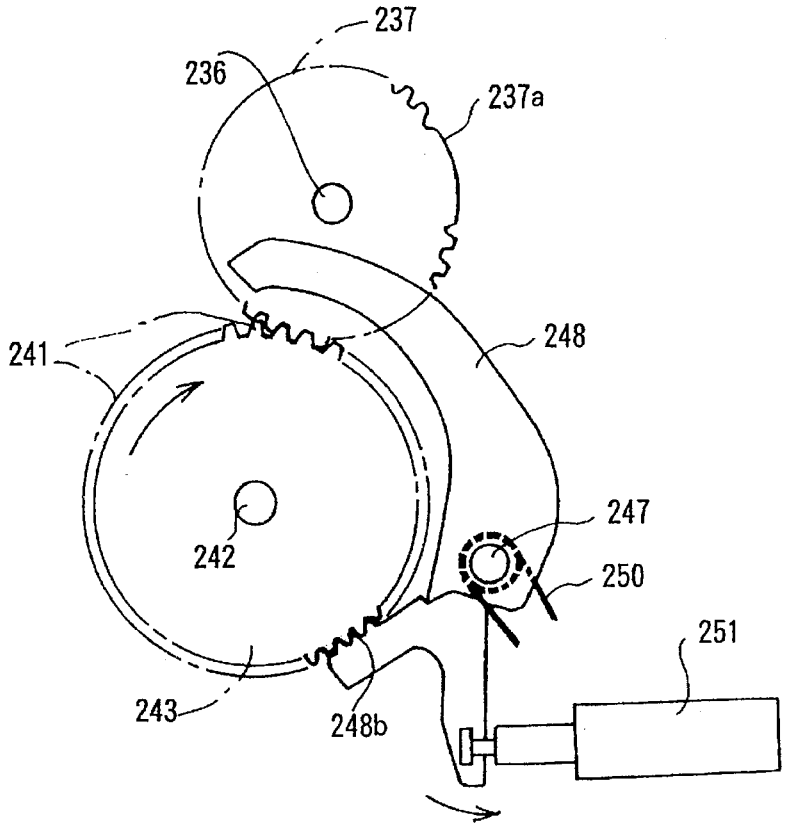
FIG. 17 (*a*) is a schematic side view showing the first lever and other components of the gear power transmission mechanism directly before start of alignment operations.
Figure 17:
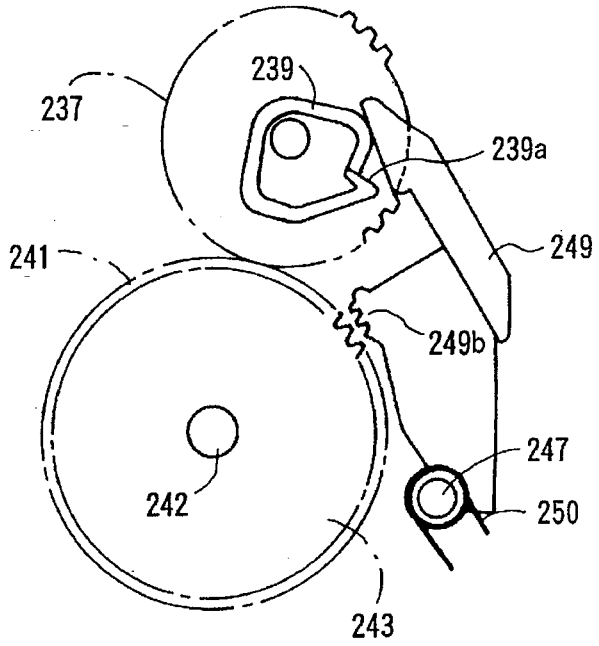
Figure 18:
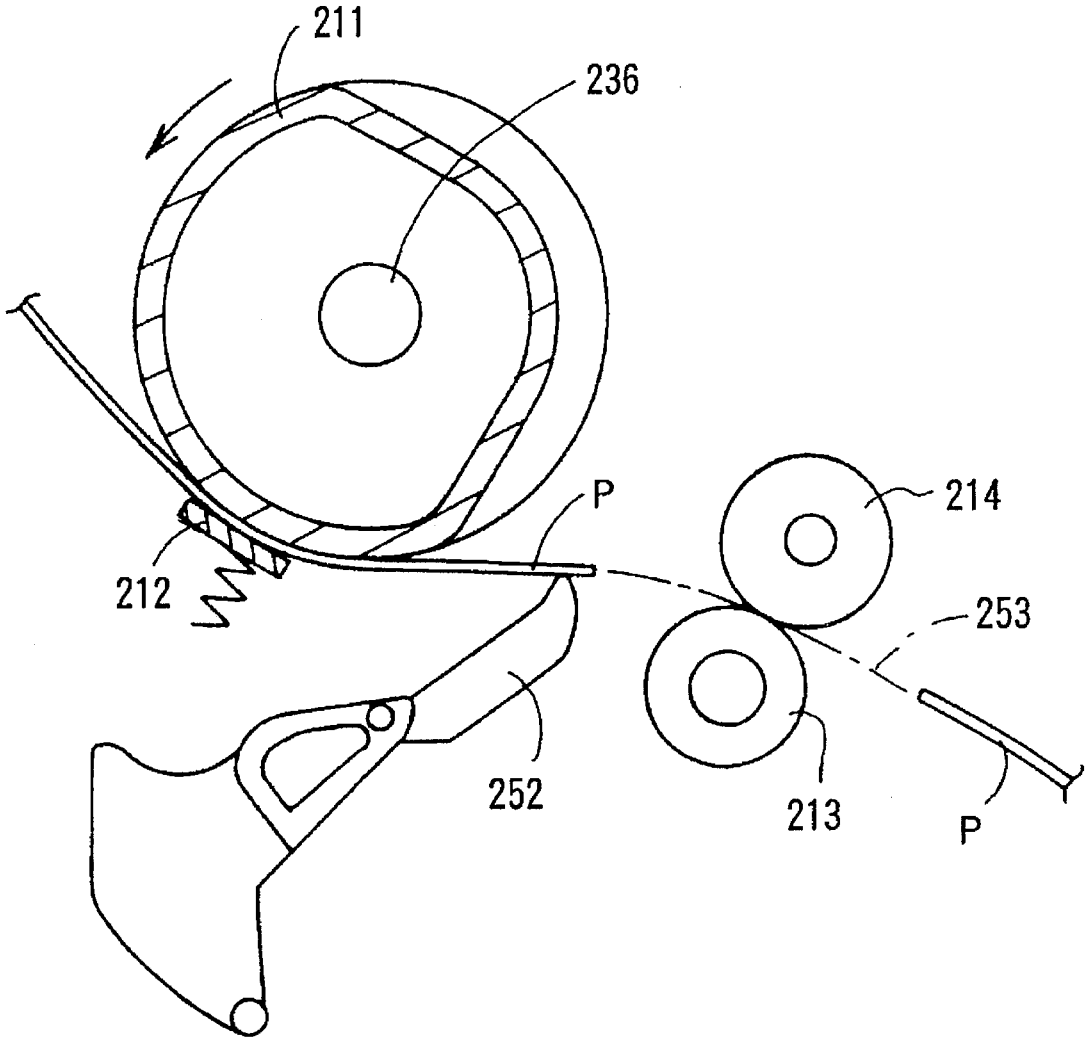
FIG. 18 is a schematic side view showing posture of a sheet-supply roller and a sheet second of the sheet-supply unit according to the second embodiment at the start of sheet supply.
Figure 19:
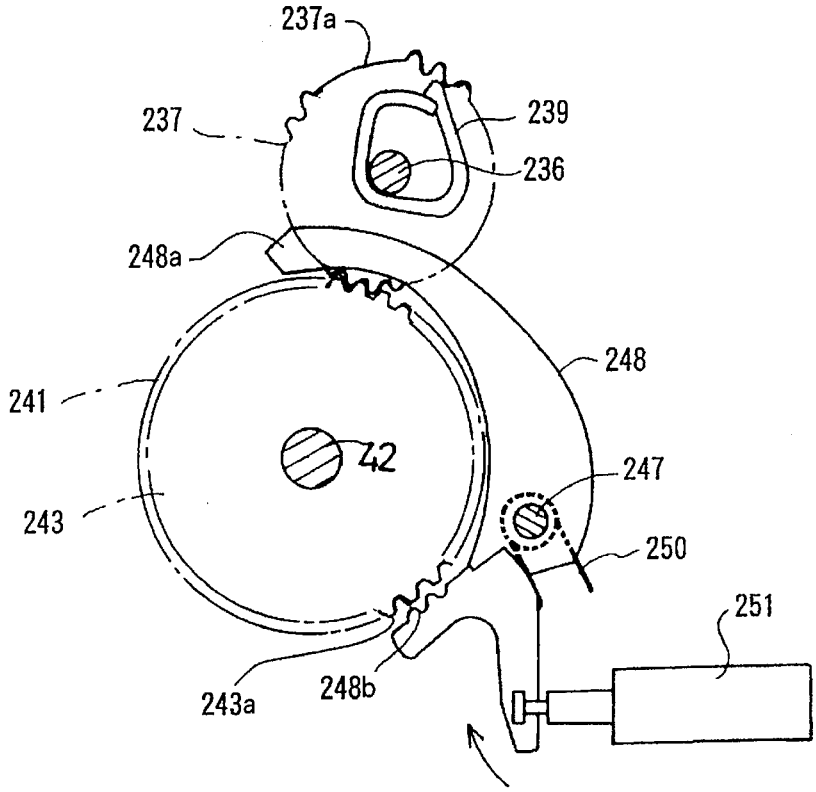
FIG. 19 (*a*) is a schematic side view showing the first lever and other components of the 9ear power transmission mechanism directly after alignment operations.
Figure 19:
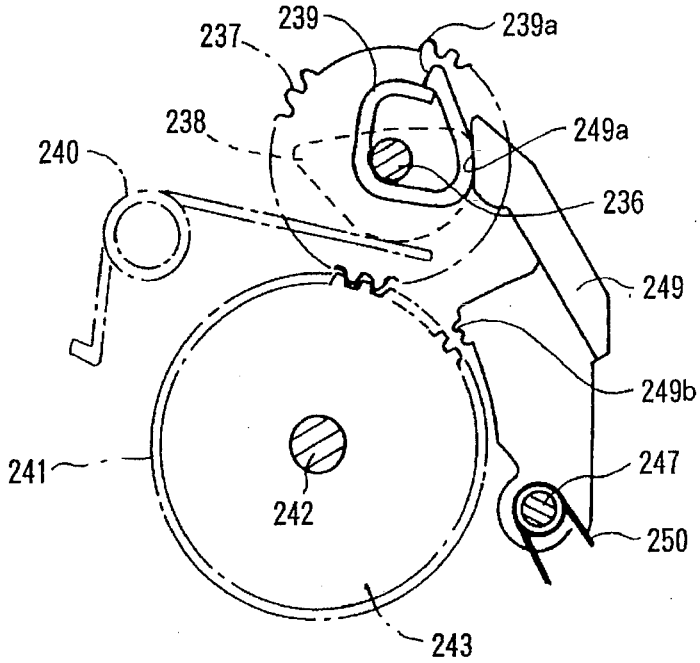

Next, an explanation of alignment operations for aligning the front edge of the sheet P by stopping the resist roller 213 will be provided. FIG. 17 (*a*), FIG. 17 (*b*), and FIG. 18 show orientation of the first lever 248, the second lever 249, and the sheet-supply roller 211 respectively directly before start of resist operations. FIG. 19 (*a*) shows orientation of the first lever 248 directly after resist operations and FIG. 19 (*b*) shows orientation of the second lever 249 at the same timing.

When the sheet sensor 252 detects the front edge of a succeeding sheet P, the sensor portion (not shown in the drawings) outputs a front edge sensing signal and the electromagnetic solenoid 251 is turned ON for a short time of, for example, about 0.2 to 0.5 seconds, directly before the front edge of the sheet P reaches the pair of resist rollers 213, 214 as shown in FIG. 18. As a result, meshing engagement between the first resist clutch engagement portion 248*b* at the base end of the first lever 248 and the large-diameter gear portion 243*a* of the resist clutch 243 is released for the short time as shown in FIG. 19 (*b*).

At this time, as shown in FIG. 19 (*b*), the tip abutment portion 249*a* of the second lever 249 is pressed upward by a large diameter portion of the stop cam 239, which rotates integrally with the partial gear 237, so that meshing engagement between the second engagement portion 249*b* and the large-diameter gear portion 243*a* of the resist clutch 243 is released. Refer to FIG. 19 (*b*). Accordingly, because in this condition the resist clutch 243 is capable of rotating freely, rotation of the transport gear 245, and accordingly the pair of resist rollers 213, 214, stops for the predetermined time. In this condition, the front edge of the transported sheet P abuts the front surface of the stopped pair of resist rollers 213, 214 so that alignment of the sheet is corrected.

Directly afterward, the electromagnetic solenoid 251 is turned OFF. The base end of the first lever 248 pivots in the direction indicated by the arrow in FIG. 19 (*a*). The first resist clutch engagement portion 248*b* meshingly engages with the large-diameter gear portion 243*a* of the resist clutch 243 so that the resist clutch 243 is locked in place. Therefore, the transport gear 245 starts rotating and the front edge of the sheet P is sandwiched between the pair of resistor rollers 213, 214 and transported. It should be noted that in this condition the tip abutment portion 249*a* of the second lever 249 remains pressed upwards against the large diameter side of the stop cam 239 so that the disengagement condition of the second engagement portion 249*b* and the large-diameter gear portion 243*a* of the resist clutch 243 is maintained.

As described above, the cam engaging portion 248*a* for stopping rotation of the partial gear 237 rotating integrally with the sheet-supply roller 211 and the first resist clutch engagement portion 248*b* for locking (engaging) the resist clutch 243 and for releasing lock (releasing engagement) of the resist clutch 243 are provided to the first lever 248 operated by the electromagnetic solenoid 250, which serves as an actuator. Also, a second engagement portion 249*b* for locking (engaging) the resist clutch 243 and for releasing lock (releasing engagement) of the resist clutch 243 is provided to the second lever 249. Because both levers operate in cooperation, the number of components required for sheet-supply operations wherein alignment operations are possible can be greatly reduced and cost of manufacture can be reduced.

Timing of lock release of the resist clutch 243, in order to temporarily stop the resist roller 213 to align a sheet P supplied from the sheet-supply unit 205 by the pair of resist rollers 213, 214, is a cooperative operation wherein, while the second lever 249 releases its engagement with the resist clutch 243 in synchronization with rotation of the cam 239, the actuator is temporarily operated so that the locked condition of the first lever 248 and the resist clutch 243 is released. Since it is a cooperative operation, the time required to release the locked condition of the resist clutch 243 can be reduced further than if this operation were performed using levers, because time is required before rotation of one lever rotates another. It also facilitates adjusting timing of sheet-supply operations, such as intermittently supplying a sheet P while performing resist operations. As a result, the interval between the rear edge of a preceding sheet P and the front edge of a subsequent sheet P can be greatly reduced. Consecutive printing operations, that is, operations for forming images on a plurality of sheets P, can be quickly performed.

Also, the gear power transmission mechanism 235 of the second embodiment takes up less space that the swing lever 42 of the first embodiment, so that the laser printer can be formed in a more compact size.

It should be noted that although in the above-described embodiment, the outer peripheral portion of the stop cam 239 for engaging with and disengaging from the cam engaging portion 248*a* of the first lever 248 was used as a common cam for swingingly pivoting the second lever 249 in synchronization with rotational phase of the partial gear 237, a separate cam can be used instead. Further, although a common coil spring 250 was used for urging both the first lever 248 and second lever 249 to pivot, separate springs could be used instead. When both the stop cam 239 and the common coil spring 250 are common, the number of necessary components and the cost of manufacture can be reduced.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A sheet-supply unit comprising:

a drive source for supplying rotational drive power;

a supply roller supplying one sheet at a time to a sheet transport pathway when rotated;

a partial gear provided so as to rotate integrally with the supply roller and be capable of receiving transmission of rotational drive power from the drive source;

a lever pivotable between a transmission mode wherein rotational drive power from the drive source is transmitted to the partial gear and a non-transmission mode wherein rotational drive power from the drive source is prevented from being transmitted to the partial gear;

a pair of resist rollers disposed in the sheet transport pathway for stopping and aligning a sheet supplied by the supply roller and for transporting the aligned sheet, and capable of receiving rotation drive power from the drive source;

an actuator capable of switching between a first mode and a second mode; and a switching mechanism for, based on the mode of the actuator, pivoting the lever into the transmission mode so that rotational drive power from the drive source is transmitted to the partial gear and so that the supply roller rotates to supply a sheet towards the pair of resist rollers and for temporarily preventing, directly before the supplied sheet reaches the pair of resist rollers, transmission of rotational drive power from the power source to the pair of resist rollers so that the supplied sheet abuts against and is aligned by the pair of resist rollers.

2. A sheet-supply unit as claimed in claim 1, the switching mechanism comprising:

an input lever pivoting in association with switching of the actuator between the first mode and the second mode, the input lever pivoting the lever into the transmission mode when the actuator is switched from the first mode to the second mode a first time;

a switch lever allowing transmission of rotational drive power from the power source to the pair of resist rollers when in an allow posture and preventing transmission when in a disallow posture; and a connection mechanism connecting operation of the input lever and the switch lever so that, when the input lever is pivoted by a second switching of the actuator from the first mode to the second mode, the switch lever pivots into its disallow posture.

3. A sheet-supply unit as claimed in claim 2, wherein the connection mechanism includes a connection lever pivotally disposed between the input lever and the switch lever at a position wherein the input lever, when pivoted by a second switching of the actuator from the first mode to the second mode, pivots the connection lever into the switch lever so that the switch lever pivots into its disallow posture.

4. A sheet-supply unit as claimed in claim 3, further comprising a sheet lever pivotally disposed in the sheet transport pathway between the supply roller and the pair of resist rollers, the sheet lever pivoting when abutted by a sheet supplied by the supply roller, and wherein the connection lever is disposed between the sheet lever and the switch lever at a position where pivoting action of the sheet lever, when the sheet switch lever is pivoted by a sheet, pivots the connection lever into a posture wherein the second switching of the actuator from the first mode to the second mode pivots the connection lever into the switch lever.

5. A sheet-supply unit as claimed in claim 4, further comprising a sheet detection mechanism for detecting presence and absence of a sheet downstream from the supply roller in the sheet transport direction, sheet detection mechanism including the sheet lever and the connection lever.

6. A sheet-supply unit as claimed in claim 3, further comprising:

a first engagement mechanism capable of engaging and disengaging the input lever and a first tip of the connection lever; and a second engagement mechanism capable of engaging and disengaging the switch lever and a second tip of the connection lever.

7. A sheet-supply unit as claimed in claim 2, further comprising:

a drive gear for transmitting rotational drive power from the drive source to the partial gear;

urging means for urging the partial gear into engagement with the drive gear; and a stopping mechanism for stopping, against urging of the urging means, the partial gear from engaging with the drive gear, the lever releasing stopping action of the stopping mechanism when pivoted into the transmission mode.

8. A sheet-supply unit as claimed in claim 1, further comprising an image forming means disposed downstream in the sheet transport direction from the pair of resist rollers and for forming an image on a sheet transported by the pair of resist rollers.

9. A sheet-supply unit as claimed in claim 1, wherein the switching mechanism includes:

a resist clutch for interrupting transmission of rotational drive power to the pair of resist rollers when free to rotate;

a lever, the lever being engagable with the resist clutch and being connected directly to the actuator so that, when the actuator is in the first mode, the lever is in the non-transmission mode and is engaged with the resist clutch, thereby preventing free rotation of the resist clutch, and so that, when the actuator is in the second mode, the lever is in the transmission mode and is disengaged with the resist clutch, thereby allowing free rotation of the resist clutch;

a second lever urged to engage with the resist clutch to prevent free rotation of the resist clutch; and a cam for disengaging the second lever from the resist clutch at a predetermined rotation phase of the partial gear.

10. A sheet-supply unit as claimed in claim 9, wherein the cam portion has an engagement portion for engaging with the first lever when the gear is in the non-transmission mode.

11. A sheet-supply unit as claimed in claim 10, wherein the lever and the second lever are mounted pivotally upon a same shaft, and further comprising an urging means provided between the lever and the second lever and for urging both the lever and the second lever into engagement with the resist clutch.

12. A sheet-supply unit as claimed in claims 11 further comprising a sheet sensor disposed in the sheet transport pathway between the sheet-supply roller and the resist roller and for detecting a front edge and an end edge of sheets following the sheet transport pathway, the actuator switching temporarily from the first mode to the second mode to start supply of a subsequent sheet when the sheet sensor detects the end edge of a prior sheet and the actuator switching again from the first mode to the second mode at a predetermined timing after start of supply of the subsequent sheet, thereby preventing transmission of rotational drive power to the pair of resist rollers directly before the subsequent sheet reaches the pair of resist rollers.

13. A sheet-supply unit as claimed in claim 9, wherein the lever and the second lever are mounted pivotally upon a same shaft, and further comprising an urging means provided between the lever and the second lever and for urging both the lever and the second lever into engagement with the resist clutch.

14. A sheet-supply unit as claimed in claims 13 further comprising a sheet sensor disposed in the sheet transport pathway between the sheet-supply roller and the resist roller and for detecting a front edge and an end edge of sheets following the sheet transport pathway, the actuator switching temporarily from the first mode to the second mode to start supply of a subsequent sheet when the sheet sensor detects the end edge of a prior sheet and the actuator switching again from the first mode to the second mode at a predetermined timing after start of supply of the subsequent sheet, thereby preventing transmission of rotational drive power to the pair of resist rollers directly before the subsequent sheet reaches the pair of resist rollers.

15. A sheet-supply unit as claimed in claims 9 further comprising a sheet sensor disposed in the sheet transport pathway between the sheet-supply roller and the resist roller and for detecting a front edge and an end edge of sheets following the sheet transport pathway, the actuator switching temporarily from the first mode to the second mode to start supply of a subsequent sheet when the sheet sensor detects the end edge of a prior sheet and the actuator switching again from the first mode to the second mode at a predetermined timing after start of supply of the subsequent sheet, thereby preventing transmission of rotational drive power to the pair of resist rollers directly before the subsequent sheet reaches the pair of resist rollers.

* * * * *